US011544986B2

(12) United States Patent
Oiyama

(10) Patent No.: US 11,544,986 B2
(45) Date of Patent: Jan. 3, 2023

(54) PAPER SHEET ACCOMMODATING UNIT AND PAPER SHEET PROCESSING DEVICE

(71) Applicant: JAPAN CASH MACHINE CO., LTD., Osaka (JP)

(72) Inventor: Hiroyuki Oiyama, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 279 days.

(21) Appl. No.: 16/768,666

(22) PCT Filed: Aug. 24, 2018

(86) PCT No.: PCT/JP2018/031341

§ 371 (c)(1),
(2) Date: May 30, 2020

(87) PCT Pub. No.: WO2019/111450

PCT Pub. Date: Jun. 13, 2019

(65) Prior Publication Data

US 2021/0125447 A1 Apr. 29, 2021

(30) Foreign Application Priority Data

Dec. 5, 2017 (JP) ..... JP2017-233203

(51) Int. Cl.
*B65H 29/46* (2006.01)
*G07D 11/00* (2019.01)
(Continued)

(52) U.S. Cl.
CPC ..... *G07D 11/13* (2019.01); *G07D 11/40* (2019.01); *G07D 2211/00* (2013.01)

(58) Field of Classification Search
CPC ..... B65H 204/6591; B65H 29/46; B65H 2404/6591; G07D 11/13; G07D 11/40; G07D 2211/00
See application file for complete search history.

(56) References Cited

U.S. PATENT DOCUMENTS 4,073,487 A 2/1978 Schirrmeister et al.
4,252,309 A 2/1981 Garrison et al.
(Continued)

FOREIGN PATENT DOCUMENTS

CN 1085868 A 4/1994
CN 1132717 A 10/1996
(Continued)

OTHER PUBLICATIONS

EPO, Extended European Search Report dated Oct. 11, 2021 in European Application No. 18887120.6, 27 pages.
(Continued)

*Primary Examiner* — Luis A Gonzalez
(74) *Attorney, Agent, or Firm* — Masuvalley & Partners; Peter R. Martinez

(57) ABSTRACT

To prevent erroneous transfer onto a paper sheet loading platform and improve the operation stability over the entire length of a long-edge direction of a pressing member by ensuring a long time during which the pressing member continues to push in a paper sheet alone. To include two rotating bodies 120 and 130 that have recesses 120*a* and 130*a* and are rotatable in opposite directions to each other in synchronization with each other, a pressing member 140 that is movable and presses an intermediate portion of a back of a paper sheet forward, a drive mechanism 180, and a paper sheet loading platform 200. The drive mechanism rotates each rotating body by an angle from 195 degrees to 270 degrees in a time period after the pressing member starts to bring a center of the paper sheet into contact with the paper sheet loading platform from an initial state until the pressing member leaves the center of the paper sheet.

5 Claims, 19 Drawing Sheets

(51) Int. Cl.
*G07D 11/13* (2019.01)
*G07D 11/40* (2019.01)

(56) References Cited

U.S. PATENT DOCUMENTS

| | | | |
|---|---|---|---|
| 5,564,691 | A | 10/1996 | Hatamachi et al. |
| 5,620,177 | A | 4/1997 | Takemoto et al. |
| 2011/0169210 | A1 | 7/2011 | Nagura et al. |
| 2016/0221786 | A1 | 8/2016 | Seki |

FOREIGN PATENT DOCUMENTS

| | | | |
|---|---|---|---|
| CN | 102126637 | A | 7/2011 |
| CN | 103955995 | B | 7/2014 |
| JP | H07125899 | A | 5/1995 |
| JP | 2012-012138 | A | 1/2012 |
| JP | 2014-044543 | A | 3/2014 |
| JP | 2016-212676 | A | 12/2016 |
| TW | 201520149 | A | 6/2015 |

OTHER PUBLICATIONS

WIPO, Japanese International Search Authority, International Search Report (with English translation) and Written Opinion dated Oct. 2, 2018 in International Patent Application No. PCT/JP2018/031341, 8 pages.

INPI, Brazilian Office Action dated Sep. 20, 2022 in Brazilian Application No. 112020008479-4, 6 pages with translation.

C—C

315°

360°

DISPENSING OPERATION

PAPER SHEET ACCOMMODATING UNIT AND PAPER SHEET PROCESSING DEVICE

RELATED APPLICATIONS

This application is the U.S. National Phase of and claims priority to International Patent Application No. PCT/JP2018/031341, International Filing Date Aug. 24, 2018, entitled PAPER SHEET ACCOMMODATING UNIT AND PAPER SHEET PROCESSING DEVICE; which claims benefit of Japanese Application No. JP2017-233203 filed Dec. 5, 2017; both of which are incorporated herein by reference in their entireties.

FIELD

The present invention relates to a paper sheet processing device provided in a paper sheet handling apparatus, such as an automatic vending machine, and relates to improvement of a paper sheet accommodating unit provided in a paper sheet processing device.

BACKGROUND

As a banknote processing device provided in a banknote handling apparatus that has a function of providing various types of goods or services by receiving an inserted banknote, such as an automatic vending machine, a game medium lending machine in a game place, a ticket-vending machine, a teller machine, and a money changer, a circulation type is known which can receive, accommodate, and dispense a plurality of denominations of banknotes.

A circulation type banknote processing device is provided with a banknote accommodating unit for storing banknotes prepared in advance for being dispensed and/or banknotes inserted in operation for each denomination or in a state where the denominations are mixed.

As the banknote accommodating unit, there are known a circulation type banknote accommodating unit and a collected banknote accommodating unit (a collection container). The circulation type banknote accommodating unit accommodates banknotes that are accommodated therein in advance for change and also accommodates a banknote inserted by a user in operation of the device once, and further has a function of discharging these banknotes to outside as change. The collection container collects all banknotes in the banknote processing apparatus at closing time and the like.

The collection container is provided in the device separately from the circulation type banknote accommodating unit provided for each denomination, and collects all denominations from respective circulation type banknote accommodating units at closing time and the like, or collects large-denomination banknotes that are not used as change.

In recent years, there has been known, as a configuration of the circulation type banknote accommodating unit, a type suitable for circulation that accommodates a banknote between portions of a tape wound and stacked spirally on an outer circumferential surface of a circulation drum. However, as the collection container that is for accommodation only and does not perform circulation, another type is frequently used which transfers and loads a transported banknote onto a banknote loading platform biased with a spring.

Patent Literature 1 discloses a banknote accommodating container including a banknote loading platform movable up and down, a pair of push-in rotating bodies that are arranged to be close to and parallel to each other, have supporting concave portions in outer circumferential surfaces which respectively support both ends in the width direction of a transported banknote, and are driven to rotate in opposite directions to each other, and a push-in member that is driven to move up and down by a drive mechanism of the push-in rotating bodies and presses the center of the banknote supported in the supporting concave portions and transfers it onto the banknote loading platform. According to this disclosure, it is said that it is possible to smoothly accommodate a newly transported banknote while efficiently pressing a banknote already loaded on the banknote loading platform irrespective of the dimension in the width direction of the banknote without increasing the number of components and increasing the size.

In this type of banknote accommodating container (the collection container), if the distance between the push-in rotating bodies is set to be wide to match with the width of a banknote with the maximum size, a banknote with a narrower width can be easily displaced in the width direction between the supporting concave portions or drop from the supporting concave portions, and it is therefore impossible to accommodate banknotes on a loading platform to be well aligned with each other by using the push-in rotating bodies only. Therefore, by providing the push-in member and rotating the push-in rotating bodies while the center in the width direction of the banknote is pushed in irrespective of the dimension in the width direction, it is possible to transfer the banknote onto the loading platform while maintaining a receiving posture and a positional relation before the banknote is pushed in.

However, in Patent Literature 1, a timing of a reciprocating operation of the push-in member, particularly a time (a time period) during which the push-in member continues to press the banknote against the banknote loading platform depends only on a rotation period of first driven gears integrated with the push-in rotating bodies. Therefore, a time during which the push-in member continues to stay at a push-in position at which the push-in member protrudes most cannot be sufficiently ensured. According to operation drawings in Patent Literature 1, the time during which the push-in member continues to stay at the push-in position is within a time period in which each push-in rotating body rotates by about 45 degrees (or an angle equal to or smaller than 45 degrees). Therefore, in most of a time after the push-in member leaves the banknote, pressing of the banknote by the push-in rotating bodies only is continued. However, the push-in rotating bodies are in contact with the banknote while pressing the banknote and rotating in order to return to their original positions. Therefore, the push-in rotating bodies can easily displace the banknote on the loading platform in the width direction. That is, if pressing of the banknote only by the outer circumferential surfaces of the push-in rotating bodies that continue to rotate in a time period during which the banknote is not sandwiched and pressed between the push-in member and the banknote loading platform, is performed for a long time, the banknote on the loading platform can be easily displaced by being led by rotation of either one of the push-in rotating bodies. In this manner, the push-in member that has pressed the banknote once retreats in a short time, and in most of a time after the retreat, the push-in rotating bodies are in contact with the banknote while rotating. Therefore, it is apparent that erroneous loading such as displacement of the banknote or drop of the banknote when the banknote is transferred can easily occur.

Further, because the push-in rotating bodies are in contact with the banknote surface while pressing the banknote surface and rotating, also during the period during which the push-in member presses the banknote against the loading platform, displacement or drop of the banknote on the loading platform can easily occur.

Furthermore, the circumferential length of the outer circumferential surface of each push-in rotating body is configured to be as long as possible because it is necessary to continue to press the banknote by the push-in rotating bodies for a long time after the push-in member leaves the banknote. Therefore, the push-in rotating bodies become large. In addition, in order to ensure a long time of pushing in the banknote by the circumferential surfaces of the push-in rotating bodies, it is necessary to set the width in the circumferential direction (the opening width) of the supporting concave portion provided in each outer circumferential surface to be as small as possible. This is because the banknote cannot be pressed by an opening of the supporting concave portion. However, if the opening width of the supporting concave portion is narrow, there is no room for design of a transport unit or the like for surely setting both ends of the banknote in the supporting concave portions located at a standby position, so that erroneous reception of a creased banknote or the like can easily occur.

In addition, the supporting concave portion becomes inevitably shallow because it is provided at a position of the push-in rotating body that is close to a circumferential surface and avoids contact with a rotation axis of the push-in rotating body. Therefore, if the depth of the supporting concave portion is increased in order to handle banknotes having various width-direction dimensions, there are errors of further increase in size of the push-in rotating bodies.

Further, in the above configuration, driving force for ejecting or retracting the push-in member having a long-edge length that matches with a banknote with the maximum size is applied only from one end portion in the long-edge direction of the push-in member. Therefore, the stability of an operation on the other end portion side during pressing is low, easily causing play or vibration in an operation of the push-in member or lowering the durability of a mechanism that guides the push-in member.

These problems occur not only in the banknote collection container but also in a paper sheet collection container of a paper sheet accommodating apparatus that handles paper sheets other than banknotes, such as tickets, cash vouchers, and securities.

CITATION LIST

Patent Literature

Patent Literature 1. Japanese Patent Application Laid-open No. 2016-212676

SUMMARY

Technical Problem

The present invention has been achieved in view of the above problems, and an object of the invention is to provide a paper sheet accommodating unit configured to press a center of a paper sheet such as a banknote, by a pressing member arranged between a pair of rotating bodies arranged in parallel to and to be close to each other, and to transfer the paper sheet onto a paper sheet loading platform while supporting both edges of the paper sheet by recesses respectively formed by cutting in circumferential surfaces of the rotating bodies, and to prevent erroneous transfer onto the paper sheet loading platform by ensuring a long time during which the pressing member pushes in the paper sheet alone, make receiving of a paper sheet stable by ensuring a sufficiently large opening width of the recess, prevent the rotating bodies from becoming large by increasing the depth of the recess in accordance with the length of a paper sheet with the maximum size, and improve the operation stability over the entire length in the long-edge direction of the pressing member.

Solution to Problem

In order to achieve the above object, a paper sheet accommodating unit according to the invention of claim 1 comprises: a paper sheet setting portion that stops a transported paper sheet at a setting position; two rotating bodies that have recesses respectively holding both edges of one paper sheet located at the setting position when being in initial rotating postures, and that are rotatable in opposite directions to each other in synchronization with each other; a pressing member that is arranged between the two rotating bodies, is located on a back side of the paper sheet located at the setting position in an initial state, comes into contact with an intermediate portion of a back of the paper sheet and pushes the paper sheet forward when protruding forward beyond the setting position, and can be ejected or retracted; a drive mechanism that drives the rotating bodies and the pressing member to cause the rotating bodies and the pressing member to work together; and a paper sheet loading platform that is located in a paper sheet accommodating space ahead of the two rotating bodies, is elastically biased toward outer circumferential surfaces of the rotating bodies to be pressed against and be in contact therewith, and can be ejected or retracted in a direction away from the rotating bodies, wherein in conjunction with an operation in which the pressing member protrudes and presses a center of the banknote forward, the rotating bodies start rotating in such directions that the edges of the paper sheet accommodated in the respective recesses are deformed to a back direction and leave from the recesses, in synchronization with each other, the pressing member stops a protruding operation in an appropriate stage after pressing of the paper sheet by the pressing member progresses and a front surface of the center of the paper sheet comes into contact with the paper sheet loading platform, the rotating bodies continue the rotating also after the pressing member stops a protruding operation, to cause both the edges of the paper sheet to leave the recesses and transfer the entire paper sheet onto the paper sheet loading platform, the rotating bodies continue to rotate in the directions also after both the edges of the paper sheet leave the recesses, to return to the initial rotating postures, the pressing member returns to the initial state before or after the rotating bodies return to the initial rotating postures, and the drive mechanism rotates each of the rotating bodies by an angle from 195 degrees to 270 degrees in a period after the pressing member starts to bring the center of the paper sheet into contact with the paper sheet loading platform from the initial state until the pressing member leaves the center of the paper sheet.

Advantageous Effects of Invention

According to the present invention, it is possible to prevent erroneous transfer onto a paper sheet loading platform by ensuring a long time during which a pressing member pushes in a paper sheet alone, make receiving of a banknote stable by ensuring a sufficiently large opening width of a recess, prevent rotating bodies from becoming large by increasing the depth of the recess in accordance with the length of a paper sheet with the maximum size, and the improve operation stability over the entire length in the long-edge direction of the pressing member.

DESCRIPTION OF EMBODIMENTS

Figure 1A:
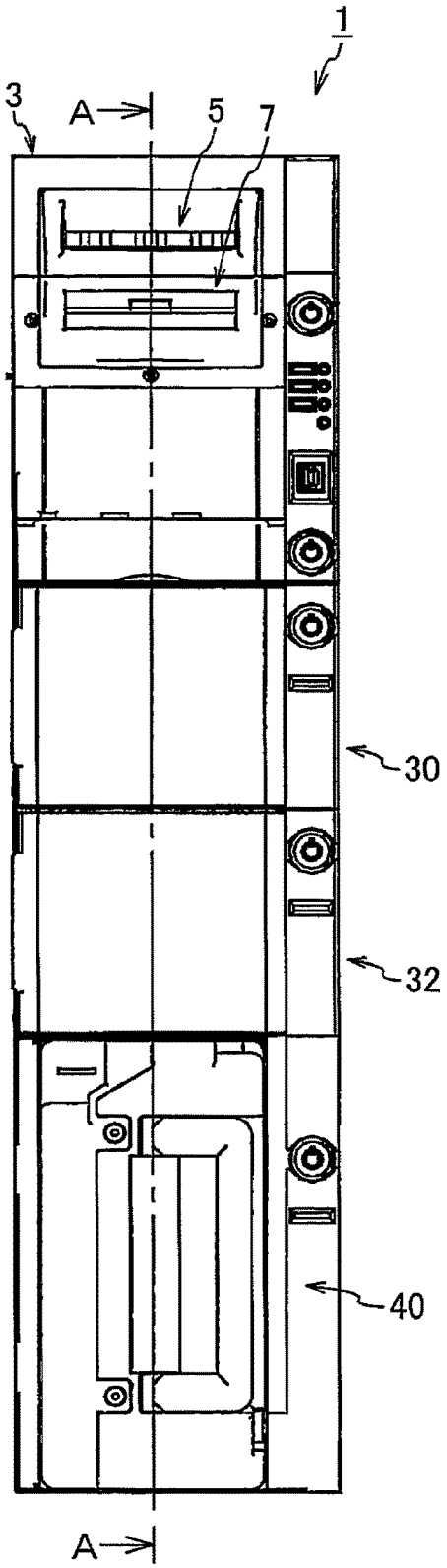
FIGS. 1(*a*) and (*b*) are a front view and an A-A cross-sectional view of a paper sheet (banknote) processing device according to an embodiment of the present invention.

The present invention will be described below in detail with an embodiment illustrated in the drawings.

Figure 1B:
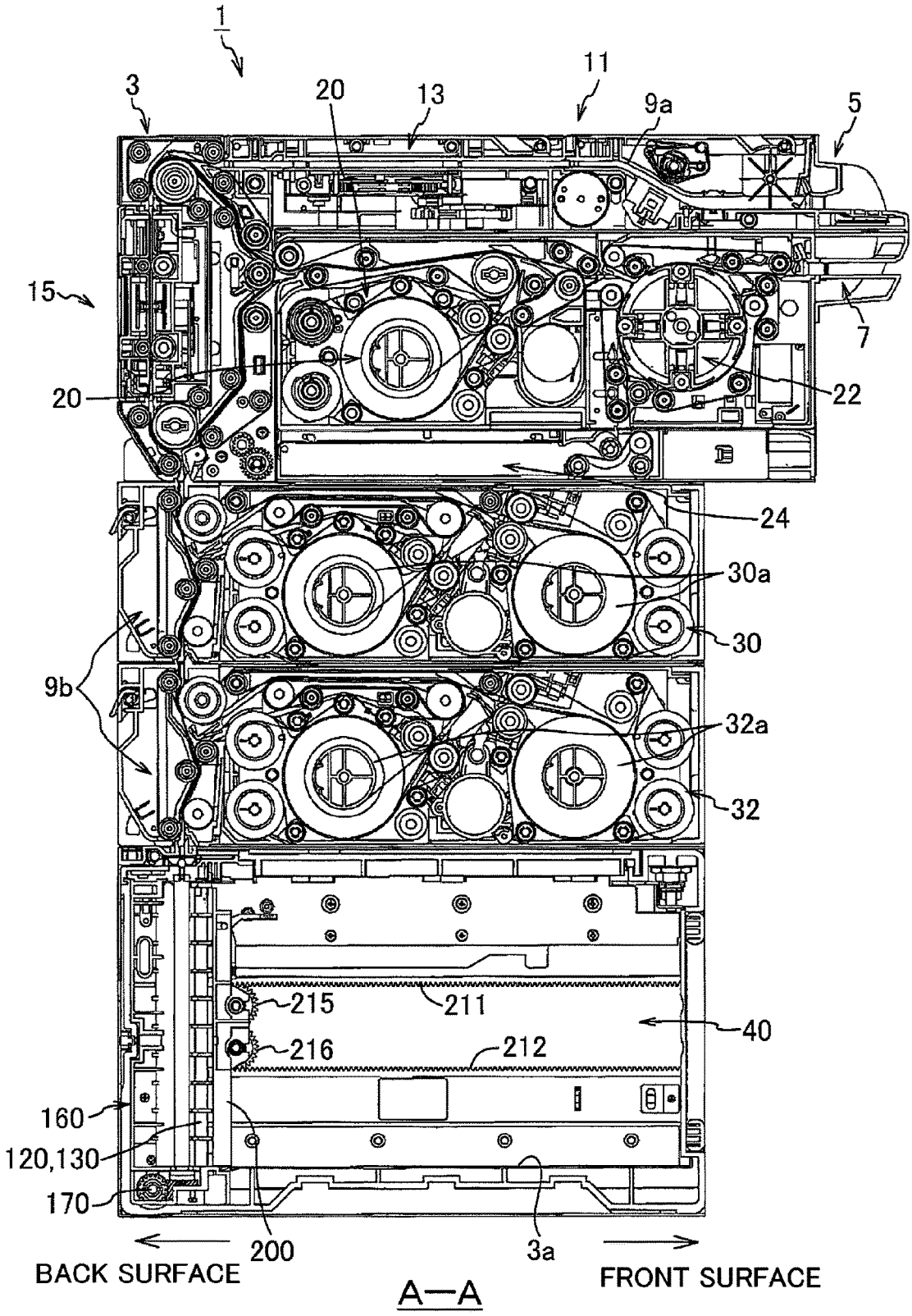
Figure 2A:
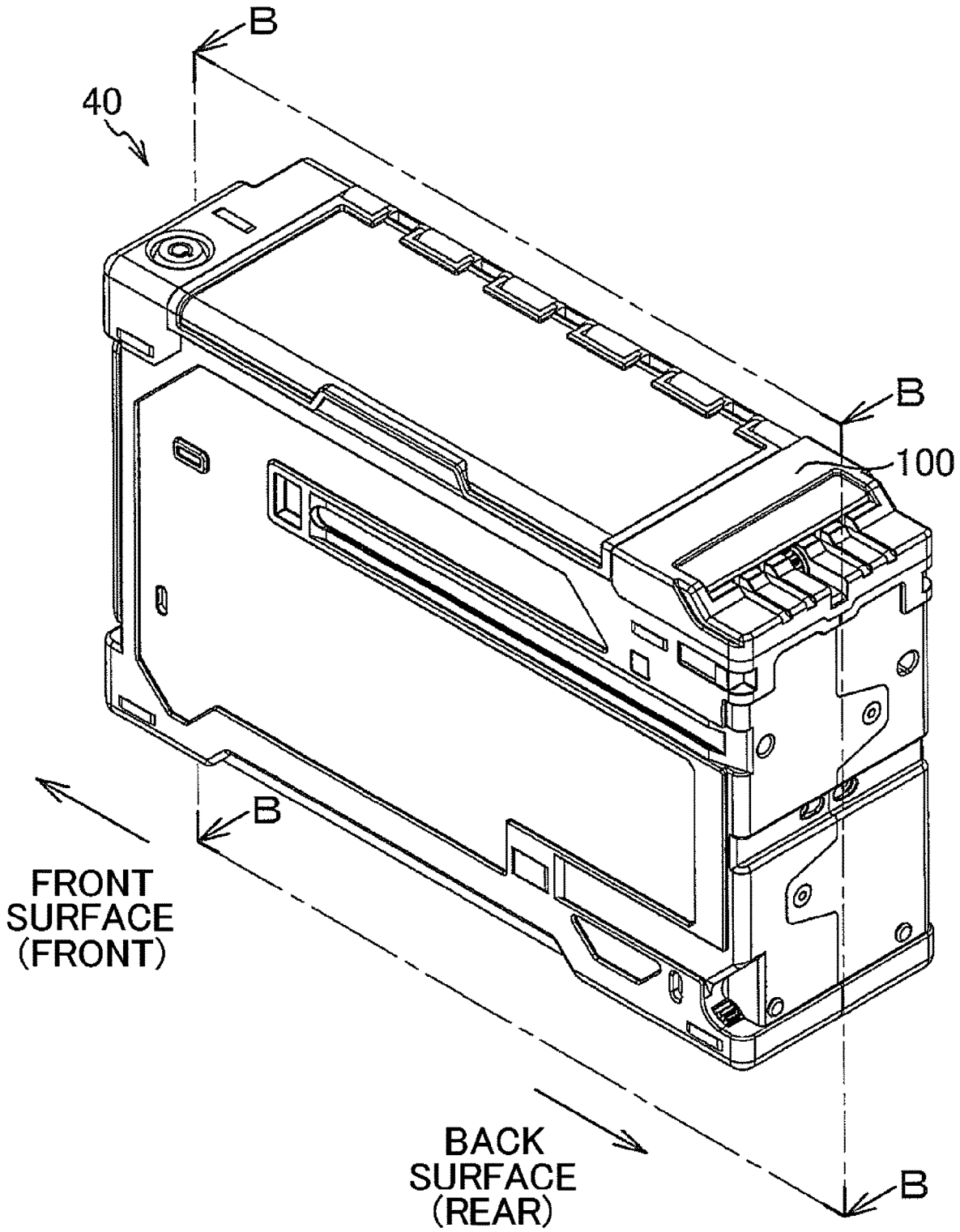
FIGS. 2(*a*) and (*b*) are perspective views of a back-side appearance and a front-side appearance of a paper sheet (banknote) accommodating unit according to the embodiment of the present invention.
Figure 2B:
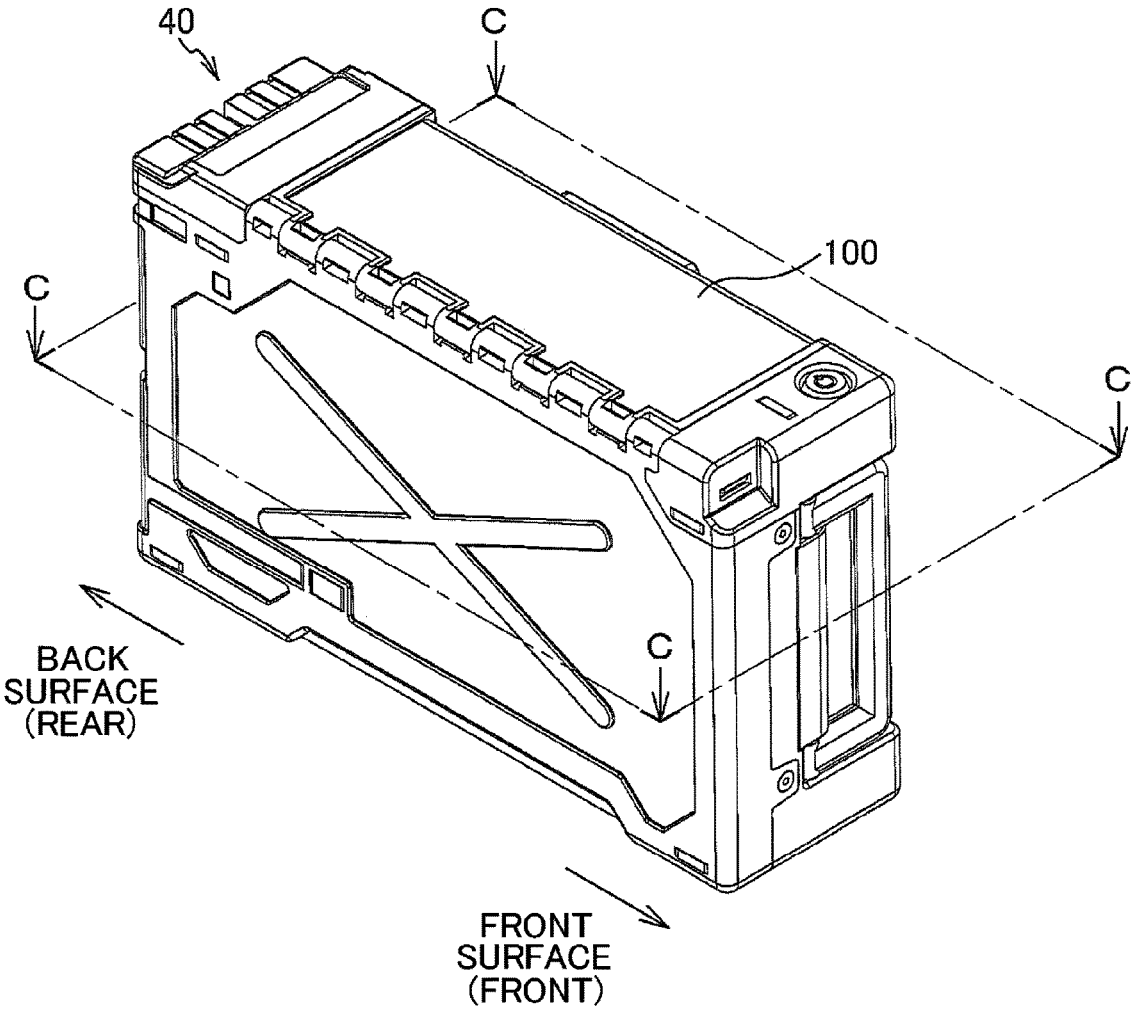
Figure 3:
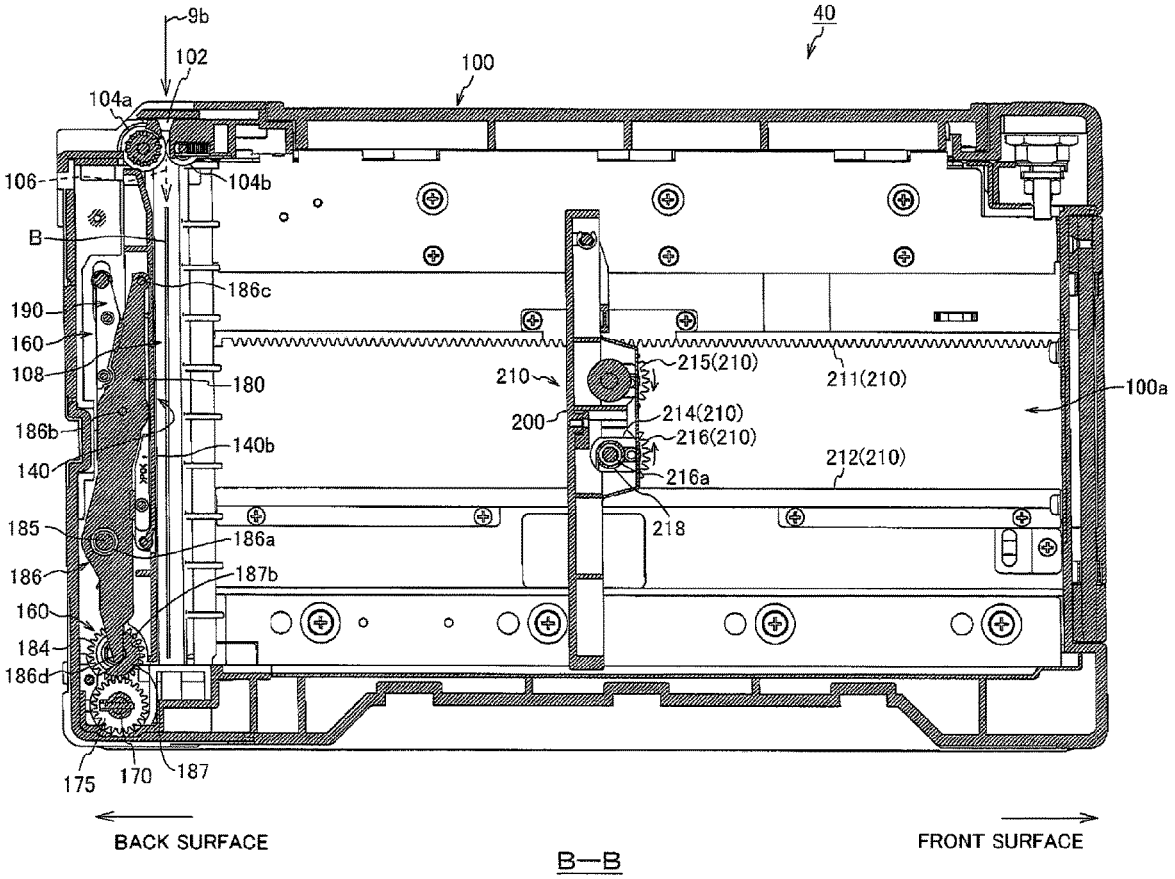
FIG. 3 is a side cross-sectional view taken along a line B-B in FIG. 2(*a*).
Figure 4:
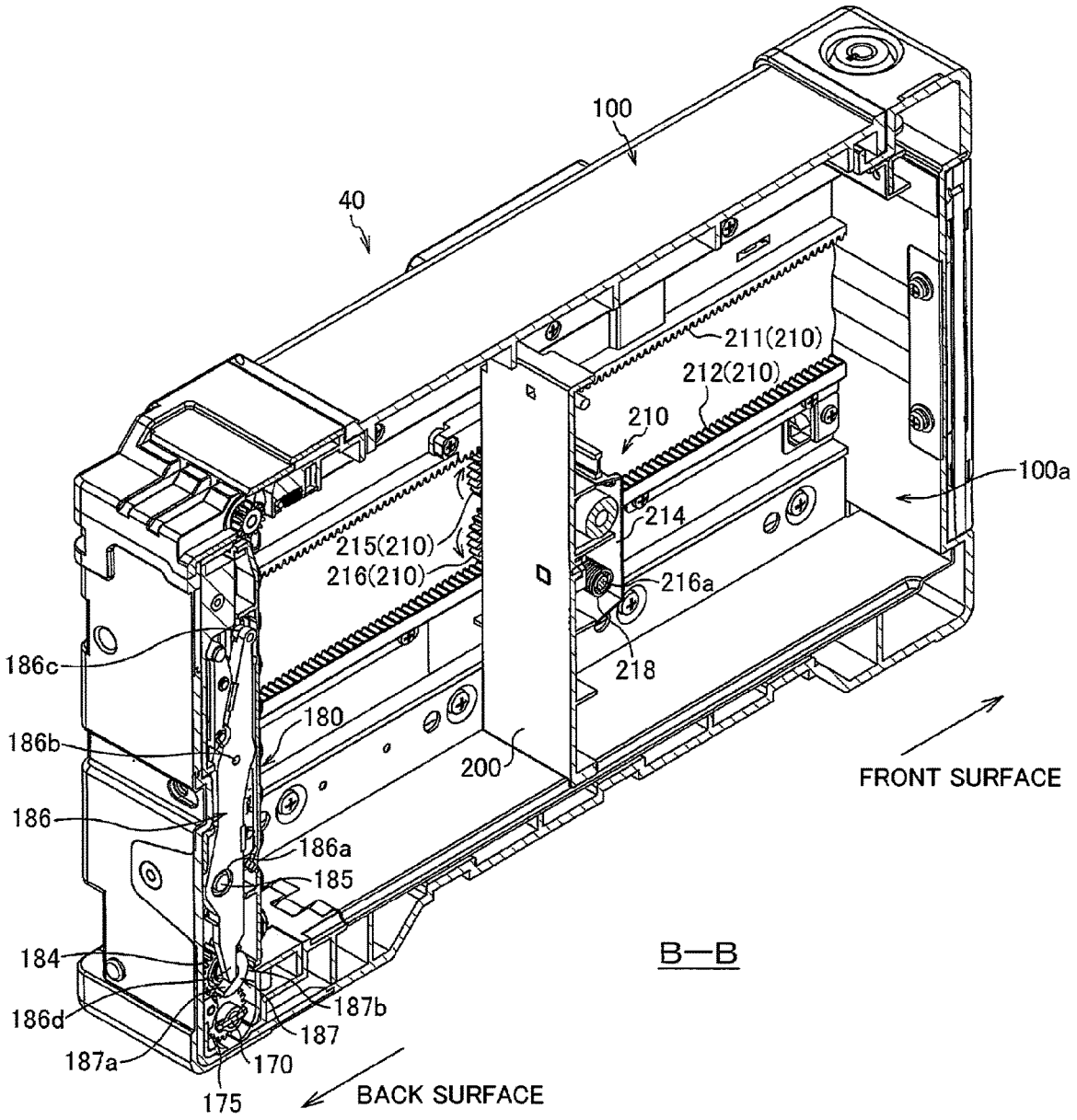
FIG. 4 is a back-side perspective cross-sectional view taken along the line B-B.
Figure 5:
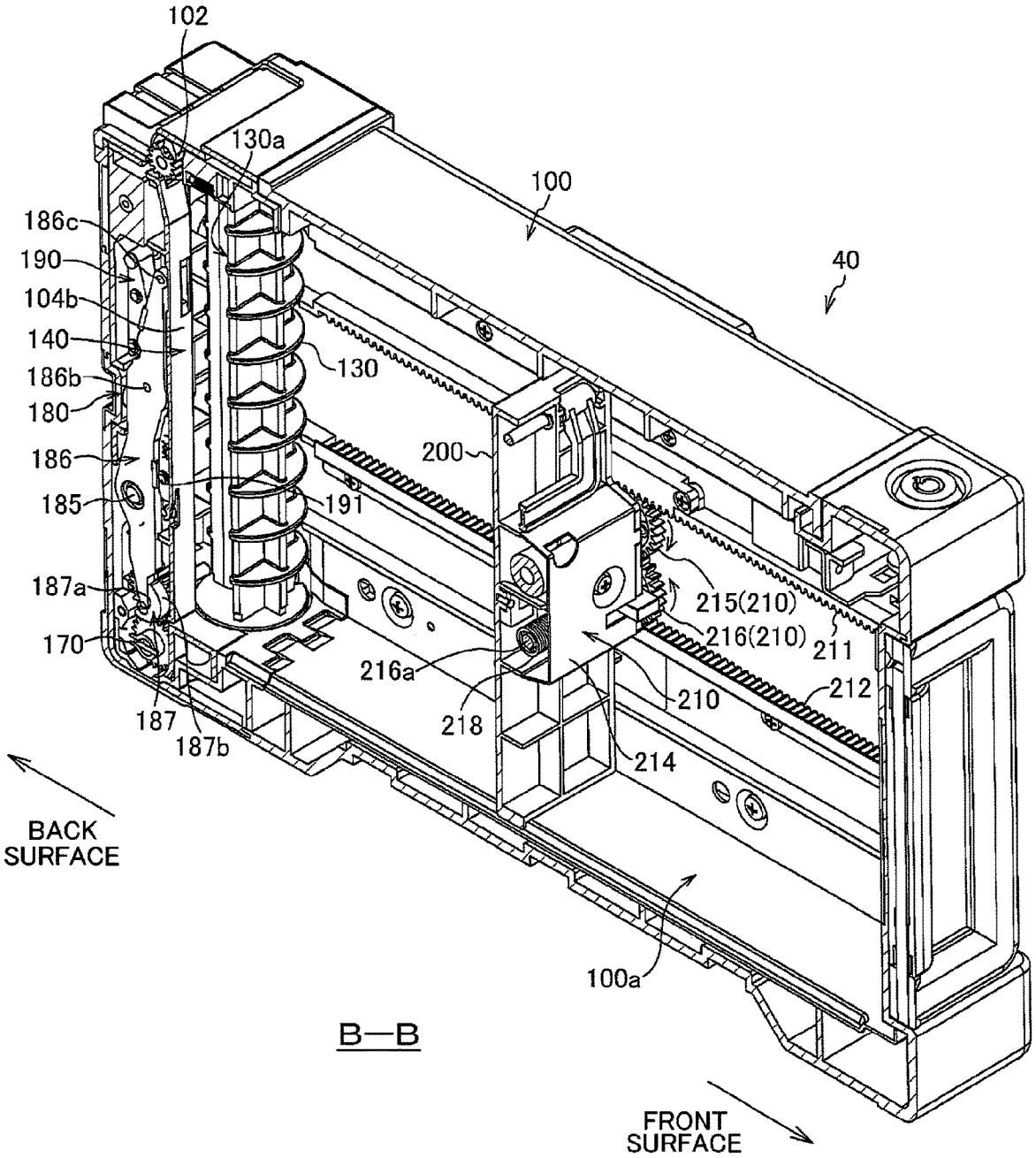
FIG. 5 is a front-side perspective cross-sectional view taken along the line B-B.
Figure 6:
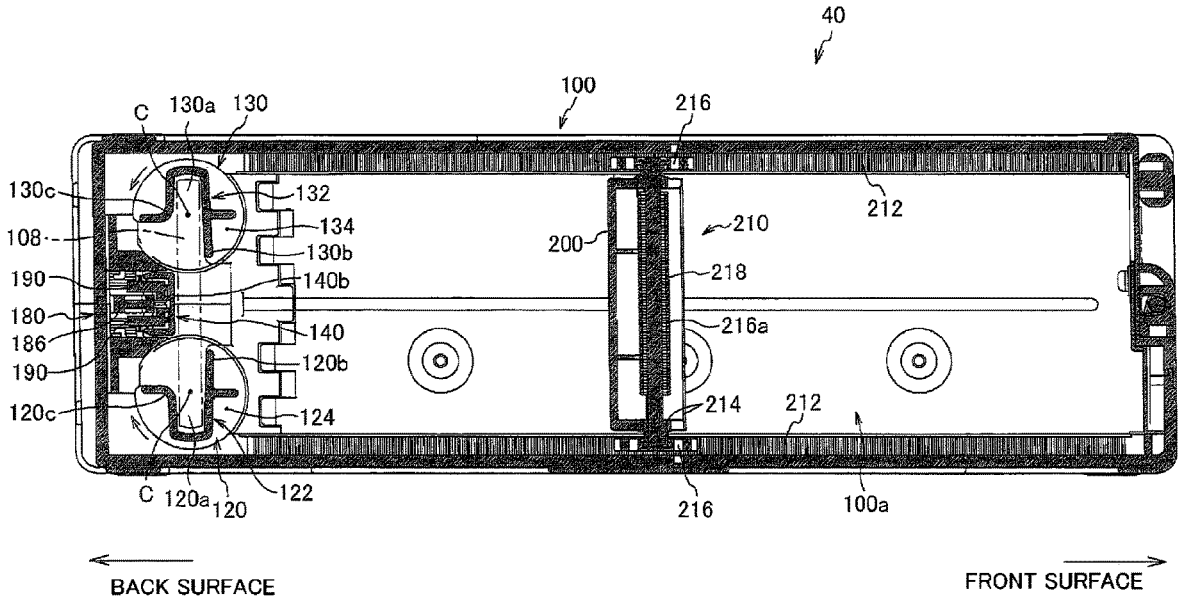
FIG. 6 is a plan cross-sectional view taken along a line C-C in FIG. 2(*b*).
Figure 7:
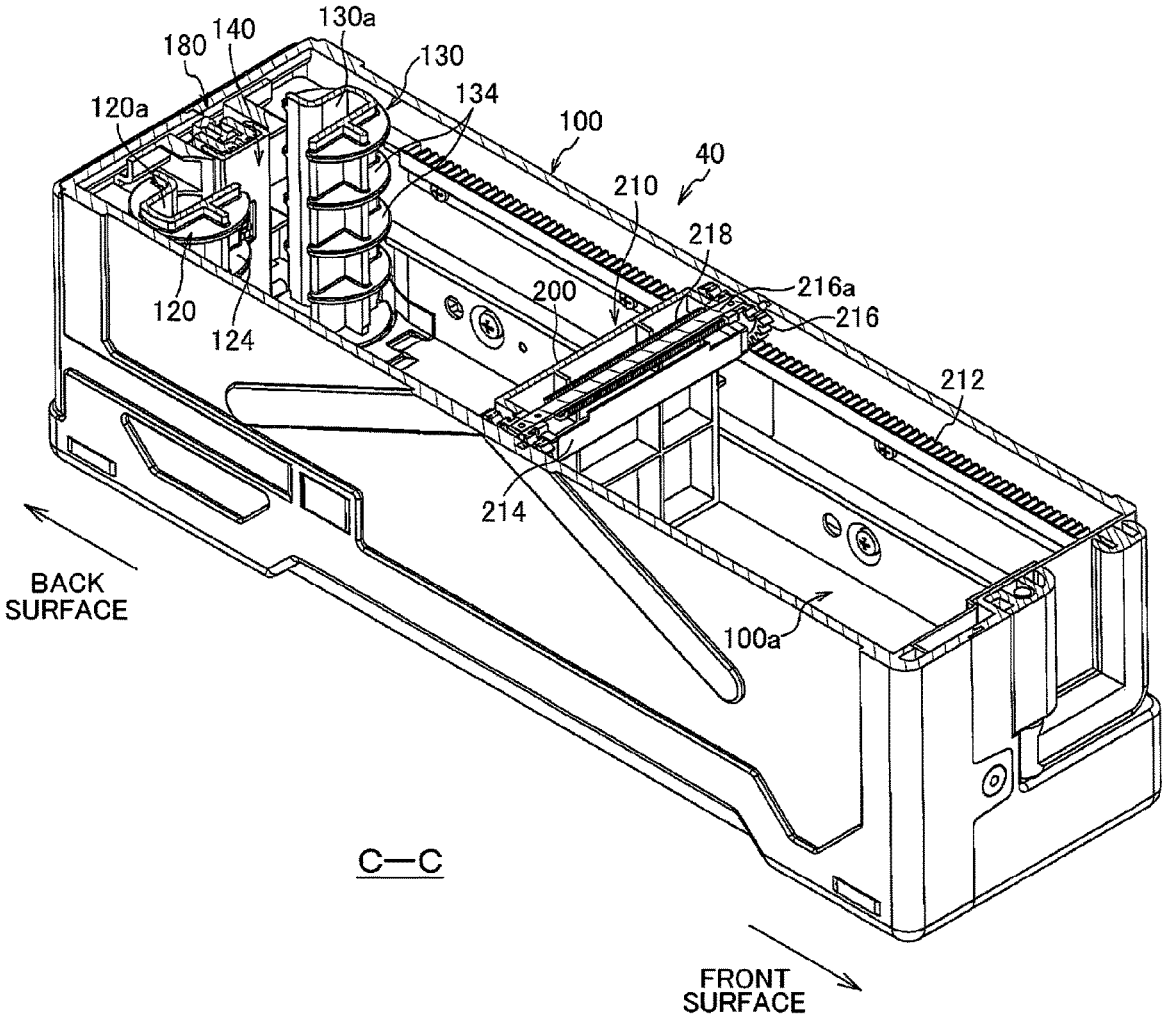
FIG. 7 is a plan-side perspective cross-sectional view taken along the line C-C.
Figure 8:
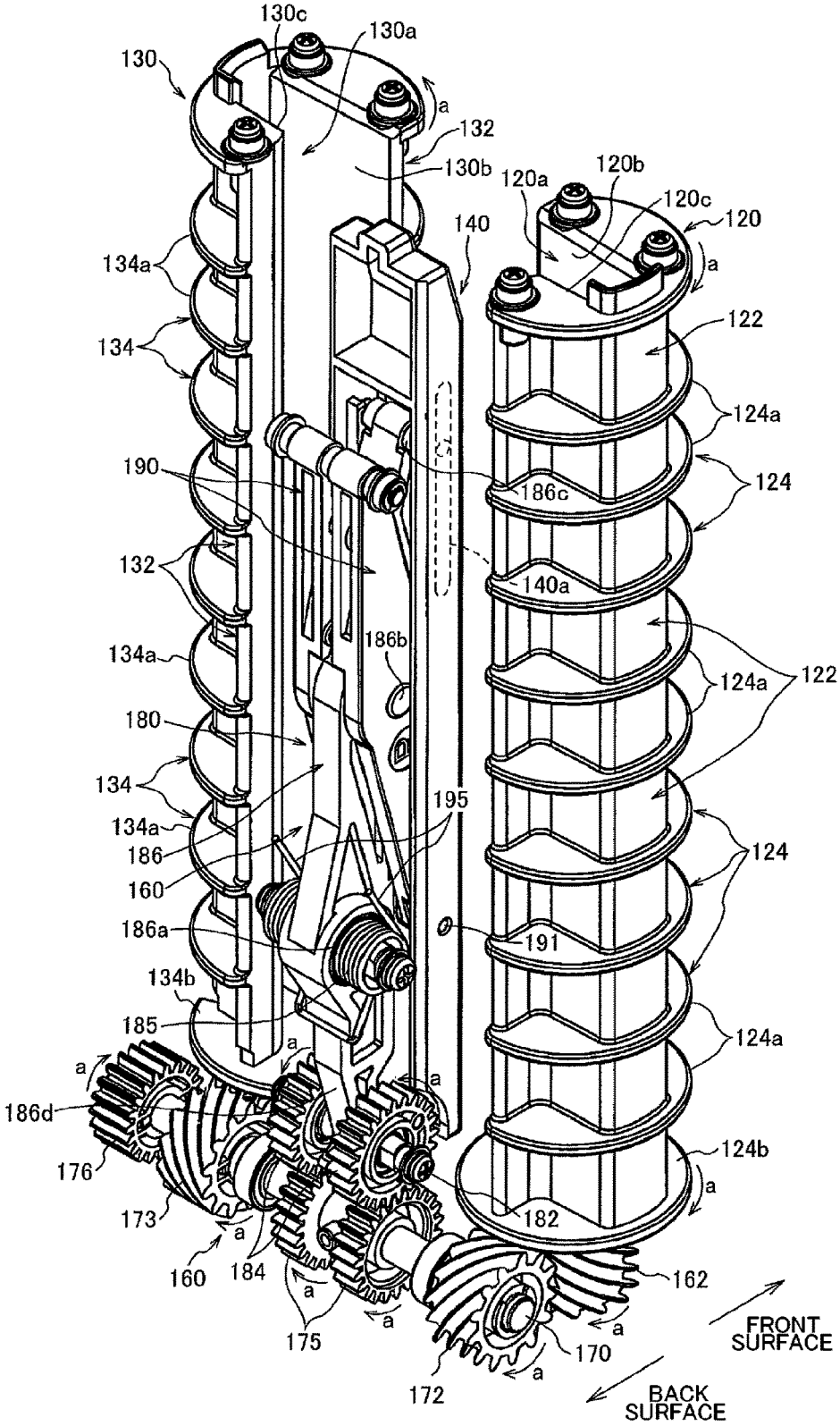
FIG. 8 is a perspective view illustrating a configuration example of a drive mechanism that causes a rotating body and a pressing member to work together.
Figure 9:
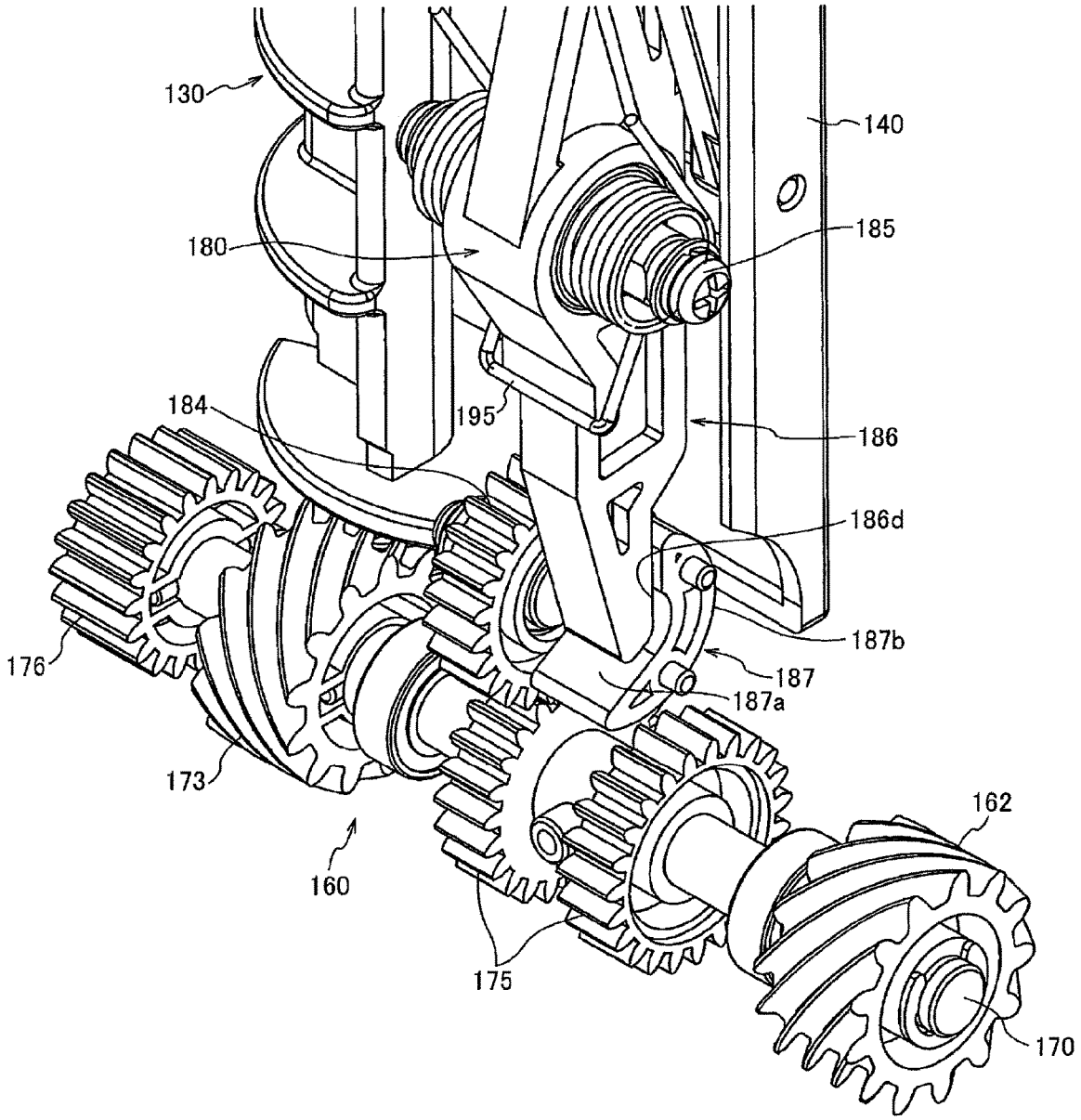
FIG. 9 is a partially omitted diagram illustrating a state of attachment of a cam member in the drive mechanism in FIG. 8.
Figure 10A:
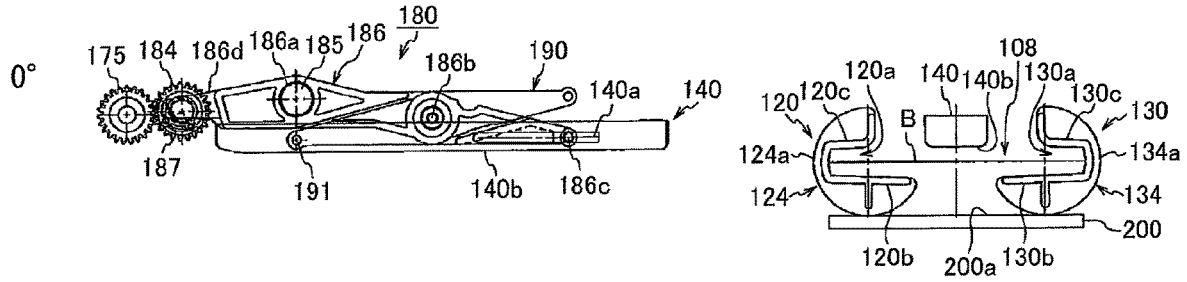
FIGS. 10(*a*) to (*e*) are diagrams that explain a procedure in which a pantograph mechanism and rotating bodies operate in accordance with progress of rotation of a cam member in order.
Figure 10B:
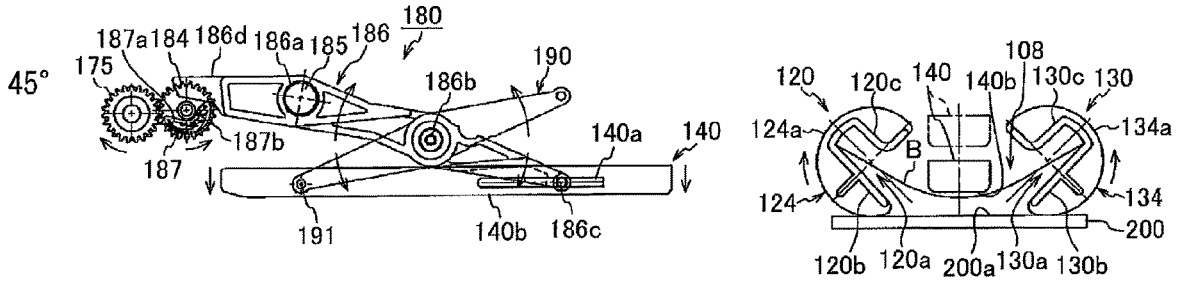
Figure 10C:
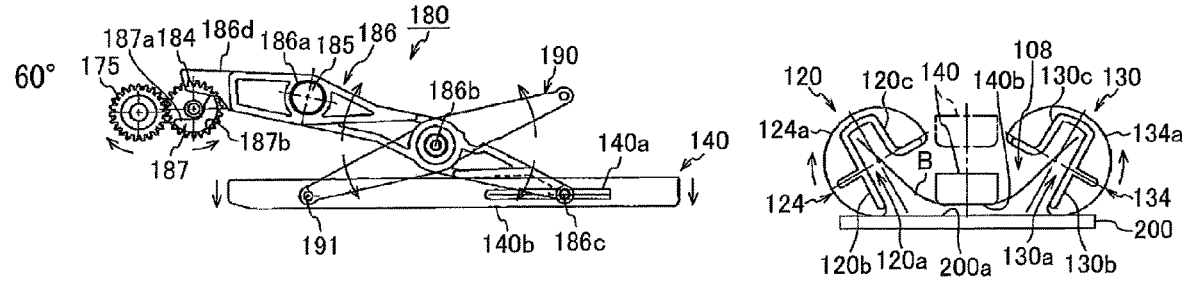
Figure 10D:
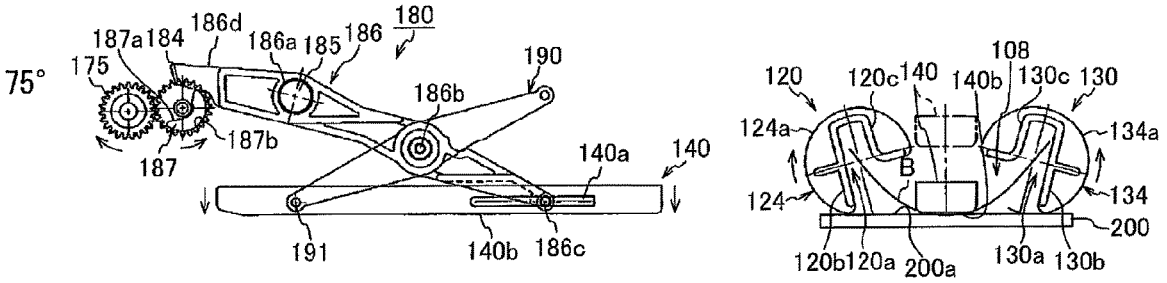
Figure 10E:
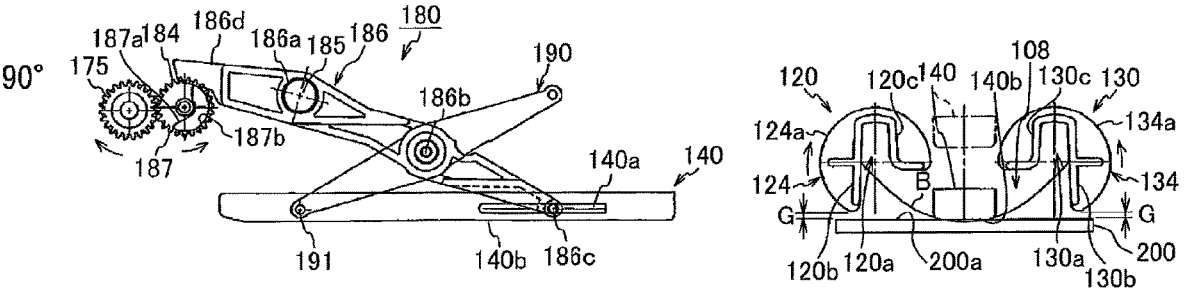
Figure 11F:
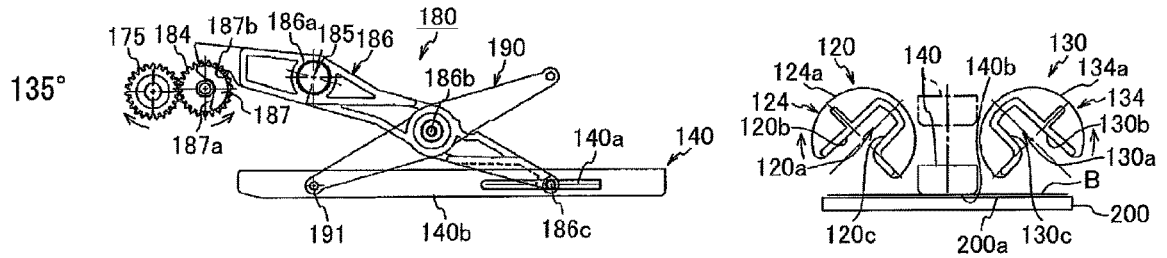
FIGS. 11(*f*) to (*k*) are diagrams that explain a procedure in which a pantograph mechanism and rotating bodies operate in accordance with progress of rotation of the cam member in order.
Figure 11G:
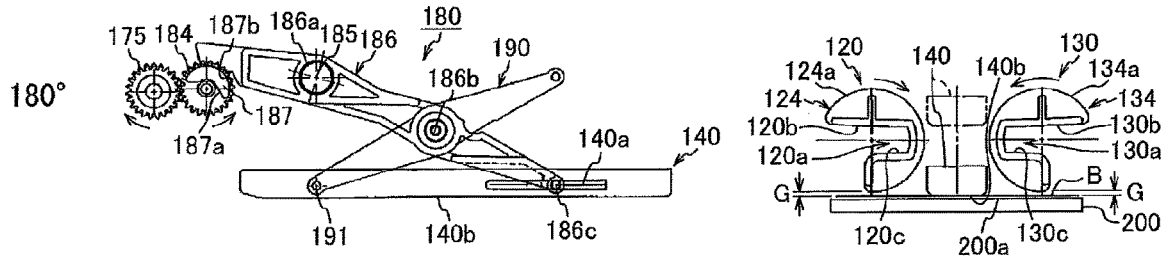
Figure 11H:
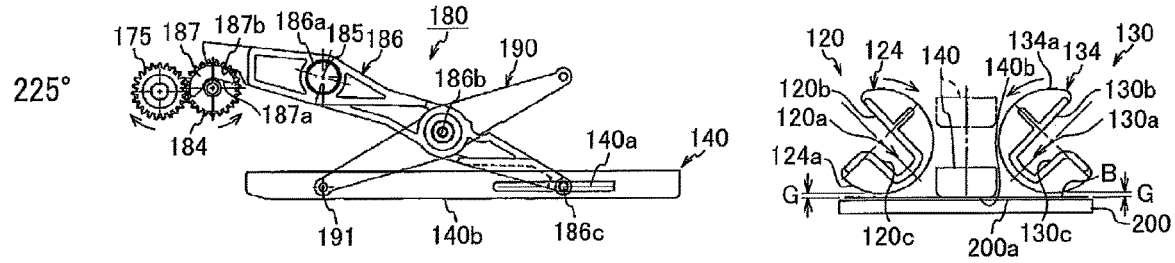
Figure 11I:
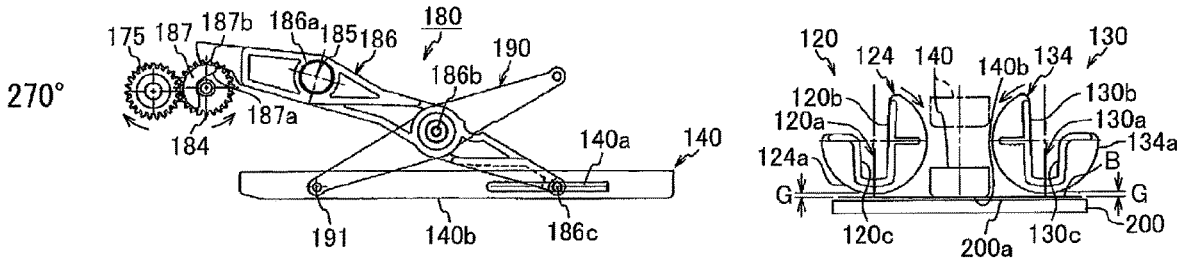
Figure 11J:
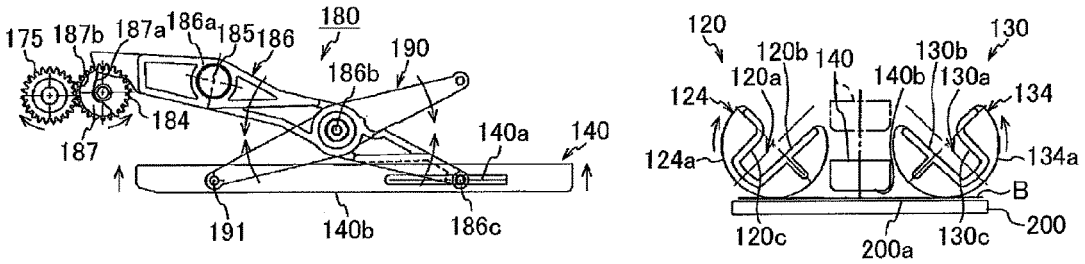
Figure 11K:
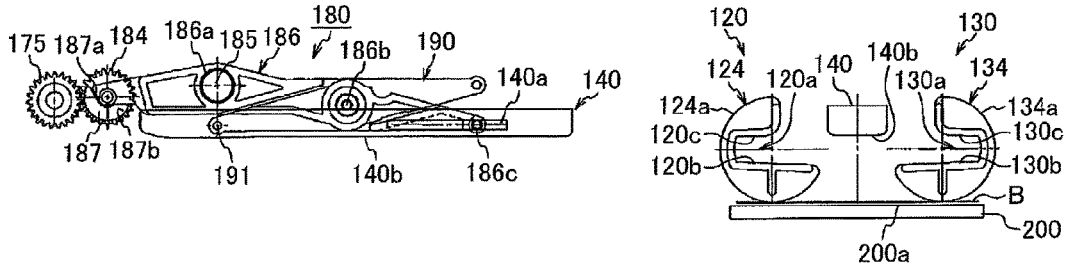

FIGS. 1(*a*) and (*b*) are a front view and an A-A cross-sectional view of a paper sheet (banknote) processing device according to an embodiment of the present invention. FIGS. 2(*a*) and (*b*) are perspective views of a back-side appearance and a front-side appearance of a paper sheet (banknote) accommodating unit according to the embodiment of the present invention. FIG. 3 is a side cross-sectional view taken along a line B-B in FIG. 2(*a*). FIG. 4 is a back-side perspective cross-sectional view taken along the line B-B. FIG. 5 is a front-side perspective cross-sectional view taken along the line B-B. FIG. 6 is a plan cross-sectional view taken along a line C-C in FIG. 2(*b*). FIG. 7 is a plan-side perspective cross-sectional view taken along the line C-C. FIG. 8 is a perspective view illustrating a configuration example of a drive mechanism that causes a rotating body and a pressing member to work together. FIG. 9 is a partially omitted diagram illustrating a state of attachment of a cam member in the drive mechanism in FIG. 8.

Although the present embodiment describes a device that processes a banknote as an example of a paper sheet, a banknote accommodating unit and a banknote processing device of the present invention can be applied to general paper sheets other than a banknote, such as cash vouchers, tickets, and securities.

A circulation type banknote processing device (hereinafter, "banknote processing device") 1 illustrated in FIG. 1 is provided in or together with a banknote handling apparatus such as a vending machine, a game medium lending machine in a game place, a ticket-vending machine, a teller machine, and a money changer, and performs a process of receiving banknotes and a process of dispensing banknotes as change or the like.

The banknote processing device 1 generally includes a case 3 that configures an outer case, a depositing/dispensing slot (depositing/dispensing unit) 5 that receives a batch of banknotes up to 30 sheets including different denominations at once and serves as a return slot when an inserted banknote is returned, a return slot (depositing/dispensing unit) 7 that serves as a dispensing slot for banknotes up to 30 sheets and as a deposit-rejected banknote return slot, a collective depositing unit (depositing/dispensing unit) 1 that separates a batch of banknotes inserted and set through the depositing/dispensing slot 5 into each banknote and introduces the separated banknote into a device main body along a deposited banknote transport path 9*a*, a centering unit (depositing/dispensing unit) 13 that is arranged on a downstream side of the collective depositing unit 11 and aligns the width-direction position of a transported banknote with a center of a transport path, a recognizing unit (depositing/dispensing unit) 15 that is arranged on a downstream side of the centering unit and determines the denomination of the inserted banknote, whether the inserted banknote is genuine, and the like using an optical sensor and/or a magnetic sensor, an escrow unit (temporarily reserving unit, depositing/dispensing unit) 20 that temporarily reserves the inserted banknote after passing through the recognizing unit up to 30 sheets, feeds the banknote to each of accommodating units and a collection container described later when deposit is confirmed, and feeds the banknote to a payout accumulating unit 22 in a cancelling and returning operation in response to a return request or the like, the payout accumulating unit (depositing/dispensing unit) 22 that accumulates a rejected banknote and/or a banknote for return and pays out the banknote to the return slot 7, a forgotten banknote accommodating unit (depositing/dispensing unit) 24 that, in a case where a returned banknote paid out from the payout accumulating unit 22 to the return slot 7 has not been taken out for a predetermined time, accommodates the returned banknote sent back by the payout accumulating unit as a forgotten banknote, first and second circulation type accommodating units 30 and 32 each of which, when receiving of an inserted banknote is confirmed, accommodates a banknote that is fed one by one from the escrow unit 20 and is transported on an accommodated banknote transport path 9*b*, for each denomination to be freely dispensable, a collection container (a collected banknote accommodating unit) 40 that is attached in an accommodating space 3*a* provided below the second circulation type accommodating unit 32 to be detachable from a front side, collects all denominations from the circulation type accommodating units at closing time and the like, and collects a large-denomination banknote not used as change and an extra banknote that cannot be accommodated in each circulation type accommodating unit, a transport mechanism configured by, for example, a motor, a solenoid, and a roller, a belt, and/or agate for generating and transmitting driving force for transporting a banknote along the transport paths 9*a* and 9*b* and other transport paths, and a control unit (not illustrated) that controls each object of control.

The maximum number of sheets of banknotes that can be handled by the dispensing slot (the depositing/dispensing unit) 5 and the return slot (the depositing/dispensing unit) 7 are merely an example.

The first and second circulation type accommodating units 30 and 32 in the present embodiment each include two circulation drums 30*a* or 32*a* each of which can accommodate up to 60 sheets. Each of the circulation drums 30*a* and 32*a* is configured to accommodate a banknote between overlapping portions of a single long tape spirally wound around an outer circumferential surface of that circulation drum, and is a type suitable for circulation. I-However, this type is merely an example.

Further, all the configurations of the depositing/dispensing units described above are merely an example.

The collection container (the collected banknote accommodating unit) 40 is described in detail below.

As illustrated in FIG. 2, FIG. 3, and the like, the collection container 40 generally includes a substantially box-shaped casing 100, a receiving inlet 102 that is formed in a back-side top surface of the casing 100 to be open and receives a banknote B one by one which is transported from the accommodated banknote transport path 9*b* in the long-edge direction, a pair of receiving rollers 104*a* and 104*b* that rotate in receiving directions to nip and introduce the banknote B introduced through the receiving inlet, a banknote setting portion (a banknote setting space) 108 that receives the banknote introduced through the receiving inlet 102 along an introduction path 106 and stops it at a setting position, two rotating bodies 120 and 130 that have recesses 120*a* and 130*a* respectively holding both edges in the width direction of one banknote received in the banknote setting portion 108 when the rotating bodies 120 and 130 are in initial rotating postures (at receiving-standby positions) illustrated in FIG. 6 and the right portion of FIG. 10(*a*), the rotating bodies 120 and 130 capable of rotating in opposite directions (banknote accommodating directions, inward directions) to each other in synchronization with each other, a pressing member 140 that is arranged between the two rotating bodies (at an intermediate position), is located on the back side of the banknote B in the banknote setting portion 108 in its initial state (a retreat state), and comes into contact with an intermediate portion in the width direction of the back of the banknote and pushes it forward when protruding forward beyond the banknote setting position, and can be ejected or retracted, a drive mechanism 160 that drives each rotating body and the pressing member to cause them to work together, and a banknote loading platform 200 that is located in a banknote accommodating space 100*a* ahead of the two rotating bodies 120 and 13, is elastically biased toward an outer circumferential surface of each rotating body to be pressed against and be in contact with the outer circumferential surface, and can be ejected or retracted in a direction away from the rotating bodies.

In conjunction with an operation in which the pressing member 140 located behind the banknote setting position in the banknote setting portion 108, that is, located at an initial state protrudes and pushes the center of a banknote forward, and during this pressing operation, the two rotating bodies 120 and 130 start rotating in synchronization with each other in such directions that edges of the banknote respectively accommodated in the recesses 120*a* and 130*a* are deformed to the back direction and leave the respective recesses. The pressing member stops a protruding operation in an appropriate stage after pressing of the banknote by the pressing member 140 progresses and a front surface of the center of the banknote comes into contact with the banknote loading platform 200 (an already loaded banknote on the banknote loading platform).

Further, also after the pressing member 140 stops a protruding operation, each of the rotating bodies 120 and 130 continues to rotate at a constant peripheral velocity, thereby causing both edges of the banknote to leave the recesses 120*a* and 130*a* and transferring the entire banknote onto the banknote loading platform.

Also after both the edges of the banknote leave the respective recesses, each rotating body continues to rotate in the same direction. After rotation by 360 degrees, each rotating body returns to its initial rotating posture and stands by for receiving a subsequent banknote.

The pressing member 140 returns to an initial state at an appropriate timing before or after each rotating body returns to the initial rotating posture.

The drive mechanism 160 rotates each rotating body by, for example, at least 90 degrees in a period after the pressing member 140 presses the center of the banknote and brings it into contact with a banknote loading platform surface 200*a* until the pressing member retreats and leaves the center of the banknote. That is, the pressing member continues to press the center of the banknote against the banknote loading platform surface until each rotating body finishes rotating by at least 90 degrees. Accordingly, it is possible to shorten a time during which the outer circumferential surfaces of the rotating bodies press the banknote against the banknote loading platform surface alone as much as possible and to prevent displacement and/or drop of the banknote caused by contact with each rotating body.

Even if the aforementioned angle of rotation of the rotating body is 90 degrees, it is possible for the pressing member to continue to press the banknote for a much longer time as compared with the technique of Patent Literature 1 in which a push-in member can stay at a push-in position for a time period in which push-in rotating bodies rotate by about 45 degrees. Accordingly, it is possible to shorten the time in which the rotating bodies press the banknote correspondingly.

The descriptions of an operation in FIGS. 10 and 11 described later refer to an example in which each rotating body rotates by about 195 degrees in a period after the pressing member 140 brings the center of the banknote into contact with the banknote loading platform surface 200*a* until the pressing member leaves the center of the banknote. As the time during which the pressing member continues to press the banknote is longer, the time period during which the rotating body is in contact with the banknote is shorter. Therefore, displacement of the banknote (a newly transferred and loaded banknote and an already loaded banknote) caused by rotation of the rotating body can hardly occur. Further, as described later, errors such as displacement of a banknote are further eliminated by setting the maximum protruding length of the pressing member in such a manner that a peripheral edge of the rotating body is not in contact with the banknote or is in very light contact in most of the time period during which the pressing member presses the banknote against the loading surface 200*a*.

Each of the rotating bodies 120 and 130 has a substantially roller shape that is symmetrical, and a portion thereof that is to be in contact with a banknote is formed of a resin material having a small frictional resistance. The dimension in the long-edge direction of each rotating body is set to match with the long-edge length of a banknote with the maximum size. Each of the rotating bodies 120 and 130 is axially supported to be rotatable by a bearing unit provided in the casing 100.

In the present embodiment, the respective rotating bodies 120 and 130 include core portions 122 and 132 that form the recesses 120*a* and 130*a* each having a substantially square U-shaped cross-section and are each formed by a plate member, and contact pieces 124 and 134 in the form of a thin plate, which are fixed with a predetermined pitch on outer surfaces of the respective core portions along the long-edge direction and have arc-shaped outer peripheral edges (outer circumferential surfaces) 124*a* and 134*a* The contact pieces 124 and 134 are not present on portions of the outer circumferences which correspond to the recesses 120*a* and 130*a* The core portions 122 and 132 have axial lengths extending over the almost entire lengths of the rotating bodies 120 and 130, respectively.

The recesses 120*a* and 130*a* are each configured to extend in a diameter direction of the corresponding rotating body 120 or 130 to include a rotation center axis c of the respective rotating bodies 120 and 130, and have a banknote-edge accommodating width and a depth that are sufficient for accommodating and holding banknote ends with room. The recesses 120*a* and 130*a* are aligned linearly with openings thereof opposed to each other when the respective rotating bodies are in the initial rotating postures illustrated in FIG. 6, the right portion of FIG. 10(*a*), and the like, thereby forming the banknote setting portion 108 in the form of a rectangle with a wide width. The shapes of the recesses 120*a* and 130*a* themselves and the distance between the recesses are set in such a manner that the banknote setting portion 108 formed between the recesses can accommodate a banknote of a denomination having the largest width-direction dimension.

Front-side edges 120*b* and 130*b* of the recesses 120*a* and 130*a* are longer than back-side edges 120*c* and 130*c*. Because the front-side edges 120*b* and 130*b* are longer, both edges of a banknote can hardly leave the inside of the respective recesses toward a front side when the respective rotating bodies are in the initial rotating postures. Further, because the back-side edges 120*c* and 130*c* are shorter, both the edges of the banknote can easily leave the respective recesses when the respective rotating bodies rotate from the initial rotating postures in banknote leaving directions indicated by arrows in FIG. 6.

As illustrated in FIG. 8. FIG. 9, and the like, the drive mechanism 160 generally includes rotating-body side driven gears 162 and 163 (163 is not illustrated) arranged at one end portions of the respective rotating bodies 120 and 130, at lower ends in the present embodiment (in bottom contact pieces 124*b* and 134*b*), a rotation-shaft member 170 that is axially supported by a bearing unit (not illustrated) to be rotatable and is arranged to cross the rotation center axis c of the respective rotating bodies, two rotating-bod driving gears 172 and 173 that are arranged to be fixed onto the rotation-shaft member and engage with the driven gears 162 and 163, respectively, a pair of pressing-member driving gears 175 and 175 fixed on the rotation-shaft member 170 between the rotating-body driving gears, a shaft-member driving gear 176 that is fixed to one end of the rotation-shaft member 170 at an axis center and transmits driving force from a motor (not illustrated) to the rotation-shaft member, and a pantograph mechanism 180 that is driven by the pressing-member driving gears 175 and 175 to eject or retract the pressing member.

In the present embodiment, by using helical gears as the rotating-body side driven gears 162 and 163 and the rotating-body driving gears 172 and 173, transmission of the driving force to each rotating body of which the rotation axis crosses the rotation-shaft member 170 at right angles can be made smooth.

The pantograph mechanism 180 generally includes a pair of driven gears 184 and 184 that are fixed at axis centers by a rotation shaft 182 that is arranged in parallel to the rotation-shaft member 170 and is axially supported by a bearing unit (not illustrated) to be rotatable, the driven gears 184 and 184 engaging with the pressing-member driving gears 175 and 175, respectively, a first link piece 186 that is axially supported by a shaft portion 185 fixed to a fixing portion in the casing 100 to be pivotable in a shaft supported portion (a shaft hole) 186*a*, and a second link piece 190 that is axially supported to be pivotable by a shaft portion 186*b* provided in the first link piece.

A pin 186*c* arranged at a tip of the first link piece 186 is loosely fitted into an elongated hole (or a long groove) 140*a* that is formed in a side surface of the pressing member 140 and extends linearly, and can be ejected or retracted within the elongated hole. Further, one surface of the other end portion 186*d* of the first link piece 186 functions as a cam follower that moves while sliding (performs sliding movement) on a peripheral edge (a concave portion (an inner peripheral edge) 187*a*, an outer peripheral edge 187*b*) of a substantially crescent-shaped cam member 187 in the form of a plate arranged integrally with the rotation shaft 182 between the pair of the driven gears 184.

As illustrated FIG. 9 in which one driven gear 184 is removed, the cam member 187 is fixed to one surface of one or both the driven gears 184 in the present embodiment.

One end portion of the second link piece 190 is axially supported by a shaft supporting portion 191 provided in the pressing member 140 to be pivotable.

Further, as illustrated in FIGS. 8 and 9, the first and second link pieces 186 and 190 are biased by a torsion spring 195 assembled around the shaft portion 185 in a retreat direction (a pantograph contracting direction).

With this configuration, when the rotation-shaft member 170 is rotated by the shaft-member driving gear 176 in an operating direction indicated by an arrow a in FIG. 8, all the gears 172, 173, and 175 fixed to the rotation-shaft member 170 are rotated in the same direction a. The rotating-body side driven gears 162 and 163 are driven by the rotating-body driving gears 172 and 173 in the operating direction a, so that the respective rotating bodies 120 and 130 are rotated in the same direction a. Further, the pair of driven gears 184 are driven by the pair of pressing-member driving gears 175 in the operating direction a, so that the cam member 187 integrated with the driven gear 184 is rotated in the same direction to cause the other end portion 186*d* of the first link piece to operate. Movement of the other end portion 186*d* of the first link piece along the peripheral edge of the cam member 187 causes the first link piece 186 to swing around the shaft portion 185 and start an operation of causing the pressing member 140 to protrude forward.

The banknote loading platform 200 is supported by a loading-platform ejecting/retracting mechanism 201 to be ejectable or retractable in the banknote accommodating space 100*a*.

As illustrated in FIGS. 3 to 7, the loading-platform ejecting/retracting mechanism 210 generally includes two rack gear pairs 211 and 212 arranged on inner surfaces of both side plates of the casing 100 to be parallel to and be opposed to each other with a predetermined vertical interval, pinion gears 215 and 216 that are arranged on the back of the banknote loading platform 200 and engage with respective gears of each rack gear pair, and a coil spring 218 that elastically biases a rotation shaft 216*a* of one pinion gear 216 in one direction. The rack gear pairs 211 and 212 extend from positions near the rotating bodies 120 and 130 to positions near a front end portion of the banknote accommodating space 100*a*, and the gears are opposed to each other, as illustrated in FIGS. 3 to 7. The pinion gears 215 and 216 are axially supported by a gear supporting portion 214 arranged on the back of the banknote loading platform 200 to be rotatable. The coil spring 218 biases the one pinion gear 216 in such a manner that the pinion gear 216 rotates in a direction (indicated by an arrow) to move the banknote loading platform toward the back side on which the rotating bodies are located. The other pinion gear 215 is driven by movement of the banknote loading platform, thereby rotating while engaging with the rack gear pair 211. Therefore, when the rotating bodies are at initial rotating positions illustrated in the right portion of FIG. 10(*a*), the loading surface 200*a* of the banknote loading platform is located at the backmost portion at which the loading surface 200*a* is in contact with the outer peripheral edges 124*a* and 134*a* of the rotating bodies as illustrated in FIG. 10(*a*), by force applied by the coil spring, unless pressing outer force in a front-surface direction is applied to the loading platform. Furthermore, also in each of a stage in FIG. 10(*b*) and subsequent stages in which the pressing member protrudes and is retracted, the loading platform surface is always in contact with at least one of or both the outer peripheral edges 124*a* and 134*a* of the rotating bodies and the pressing surface 140*b* of the pressing member.

The illustrated configuration for elastically biasing the banknote loading platform in one direction is merely an example.

Further, in the illustrated example, the collection container 40 is placed horizontally. However, it is needless to mention that the collection container 40 can be operated in an identical manner even when it is placed vertically

[Banknote Accommodating Operation]

Next, an example of a banknote accommodating operation is described, referring to FIGS. 10 and 11.

FIGS. 1(*a*) to (*e*) and FIGS. 11(*f*) to (*k*) are diagrams that explain a procedure in which the pantograph mechanism 180 (the pressing member 140) and the rotating bodies 120 and 130 operate in accordance with progress of rotation of a cam member in order. A left portion of each drawing illustrates the pantograph mechanism, and a right portion illustrates the rotating bodies and the pressing member.

FIG. 10(*a*) illustrates an initial state that waits for introduction of the banknote B from the accommodated banknote transport path 9*b*. The respective rotating bodies 120 and 130 are in a state where openings of the recesses 120*a* and 130*a* are opposed to each other, and the banknote setting portion (the banknote setting space) 108 formed between both the recesses is substantially rectangular. Because the banknote loading platform 200 is always biased by the coil spring 218 to the back side on which the rotating bodies are located, the banknote loading platform 200 maintains a state where the loading surface 200*a* is pressed against the outer peripheral edges 124*a* and 134*a* of the contact pieces 124 and 134 of the respective rotating bodies to be in contact therewith.

In this standby state, a front surface (the pressing surface 140*b*) of the pressing member 140 retreats behind the banknote setting portion 1018 not to obstruct entrance of a banknote into the banknote setting portion. In this state, no driving force is transmitted from a motor to the shaft-member driving gear 176. Therefore, the rotation-shaft member 170 and all the gears 172, 173, and 175 fixed thereto, the respective driven gears 162 and 163, and the driven gear 184 are also stopped.

In this standby stage, the first and second link pieces 186 and 190 are biased in a retreat direction (a pantograph contracting direction) by an action of the torsion spring 195, and are stopped. Further, the other end portion 186*d* of the first link piece which functions as a cam follower fits into the concave portion 187*a* of the cam member 187 having a substantially crescent shape. In the state where the other end portion 186*d* of the first link piece fits into the concave portion of the cam member 187 as illustrated in the left portion in FIG. 1(*a*), the first link piece 186 that swings around the shaft portion 186*b* and the second link piece 190 maintain such postures that they are located to be close to the back of the pressing member 140 in a folded state. At this time, the pin 186*c* of the first link piece is located near a right end portion of the elongated hole 140*a* provided in the pressing member. Therefore, the pressing member 140 maintains a state where it retreats at the backmost position.

In the initial state in (a), the banknote B that has been transported on the accommodated banknote transport path 9*b* while facing don is introduced into the receiving inlet 102 along the introduction path 106 by rotation of the pair of receiving rollers 104*a* and 104*b*, falls into the banknote setting portion 108, and is stopped. At this time, both edges in the width direction of the banknote are in a state of being supported in the recesses 120*a* and 130*a* of the respective rotating bodies.

Because each recess passes through the rotation center axis c of the corresponding rotating body, it is possible to form a banknote holding space that has a wide opening width and a deep depth. Accordingly, it is possible to surely accommodate and hold even a banknote having a deformed portion.

Each rotating body starts rotation from the initial state in (a) and ends one revolution of 360 degrees at the last stage in (k).

(b) illustrates a state where the cam member 187 is caused to pivot from the initial state in (a) by 45 degrees in a counterclockwise direction by rotation of the pressing-member driving gear 175. In all stages after (b), the driving force continues to be transmitted to the shaft-member driving gear 176, so that the rotation-shaft member 170 and all the gears 172, 173, and 175 fixed thereto are caused to pivot by required angles. In accordance with the pivotal movement, the driven gears 162 and 163 fixed to the respective rotating bodies and the driven gear 184 that drives the pantograph mechanism are also caused to pivot by required angles. In the stage in (b), the other end portion 186*d* of the first link piece leaves the inside of the concave portion 187*a* of the cam member 187 having a substantially crescent shape against biasing by the torsion spring 195 and starts to be pressed backward by a right end portion of a cam with a pointed shape. Therefore, the first link piece 186 pivots around the shaft portion 185 in a clockwise direction, and the pin 186*c* at one end pushes the pressing member 140 forward while moving in the elongated hole 140*a* to left. At this time, the shaft supporting portion 191 at one end of the second link piece 190 presses a left portion of the pressing member forward. Therefore, the pressing member protrudes forward with the same posture by a predetermined length while maintaining left and right balance, comes into contact with the center of the back of a banknote, and starts to press the center forward. That is, the pressing member can always move parallel in a stable manner while maintaining the same posture.

In this stage, the rotating bodies 120 and 130 pivot by approximately 45 degrees in such directions that the front-side edges 120*b* and 130*b* are inclined forward as illustrated in the right portion of (b)(the banknote leaving directions). Therefore, together with an operation of pressing the center in the width direction of a banknote by the pressing member 140 that starts to protrude, the banknote is entirely bent and deformed symmetrically with both edges thereof are deformed backward.

Subsequently, in FIGS. 10(*c*) to (*e*) and FIGS. 11(*f*) to (*j*), the other end portion 186*d* of the first link piece relatively passes beyond the right end portion of the cam member 187 with a pointed shape and is transferred to the arc-shaped outer peripheral edge 187*b* of the cam member, and continues to relatively move along the outer peripheral edge.

First, in (c), the cam member further pivots more than in the state in (b) by 15 degrees, that is, by 60 degrees in total from the initial state the counterclockwise direction, and the respective rotating bodies 120 and 13 also further pivot by 15 degrees in the banknote leaving directions. By the further pivotal movement of the cam member by 15 degrees, the first link piece and the second link piece protrude (extend) forward by distances corresponding to that pivotal movement, thereby causing the pressing member 140 to further protrude. In this stage, the pressing member 140 does not bring the banknote B into contact with the loading surface 200*a* of the banknote loading platform 20). The outer peripheral edges 124*a* and 134*a* of the respective rotating bodies maintain contact with the pressing surface 140*b* of the pressing member. Because the postures of the recesses 120*a* and 130*a* of the respective rotating bodies come close to perpendicular postures, both ends of the banknote can leave easily.

In (d), the cam member further pivots more than in the state in (c) by 15 degrees, that is, by 75 degrees in total in the counterclockwise direction, and the respective rotating bodies 120 and 130 also further pivot by 15 degrees in the banknote leaving directions. By the further pivotal movement of the cam member by 15 degrees, the first link piece and the second link piece protrude (extend) forward by distances corresponding to that pivotal movement, thereby causing the pressing member 140 to further protrude. In this stage, the pressing member 140 starts to come into contact with the loading surface 200*a* of the banknote loading platform 200 via the banknote B. However, the end portions of the outer peripheral edges 124*a* and 134*a* of the contact pieces 124 and 134 of the respective rotating bodies still maintains a state of being pressed against the loading surface 200*a* of the banknote loading platform 20 to be in contact therewith. Because the postures of the recesses 120*a* and 130*a* of the respective rotating bodies come further close to the perpendicular postures, both ends of the banknote can leave further easily.

After (e), each rotating body continues to rotate and the outer peripheral edge of each of the contact pieces 124 and 134 is separated from the loading surface, so that the opening of each of the recesses 120*a* and 130*a* face the loading surface. Therefore, only the pressing member 140 continues to be in contact with the loading surface 200*a*. Further, because the pressing member protrudes forward more in the stages in FIG. 10(*e*) and FIG. 11(*f*) to FIG. 11(*i*) than in the stage in (d) in the present embodiment, the circumferential surface of each rotating body is not contact with or is in light contact with the pressing surface 140*b* in FIGS. 11(*g*) to (*i*). In each of the stages in FIG. 10(*e*) and FIG. 11(*f*) to FIG. 11(*i*), the protruding position of the pressing member is not changed because the arc shape of the arc-shaped outer peripheral edge 187*b* of the cam member 187, with which the other end portion 186*d* of the link piece comes into contact, is set to be equidistant from the center of rotation of the cam member.

In FIG. 10(*e*), the cam member further pivots more than in the state in (d) by 15 degrees, that is, by 90 degrees in total in the counterclockwise direction, and the respective rotating bodies 120 and 130 also further pivot by 15 degrees in the banknote leaving directions. Therefore, the postures of the recesses 120*a* and 130*a* of the respective rotating bodies become perpendicular to the loading surface 200*a*, so that both ends of the banknote can leave further easily. Although the other end portion 186*d* of the first link piece is located to be close to a leading end portion of the arc-shaped outer peripheral edge 187*b* of the cam member in (d), it further rides on the outer peripheral edge in (e). By the further pivotal movement of the cam member by 15 degrees, the first link piece and the second link piece protrude (extend) forward slightly, so that the pressing surface 140*b* of the pressing member slightly protrudes more than in the state in (d). In other words, it is possible to finely adjust the protrusion length of the pressing member by adjusting the shape of the outer peripheral edge 187*b* of the cam member as appropriate. In the present embodiment, the protrusion length in the stage in (e) and the subsequent stages is set to be larger than the protrusion length in the stage in (d). In the stage in (e) and the subsequent stages, the outer peripheral edges 124*a* and 134*a* of the contact pieces of the respective rotating bodies are separated from the loading surface. Therefore, the pressing member 140 maintains a state where it presses the banknote loading platform 200 alone via the banknote B.

The above descriptions related to the shape of the outer peripheral edge 187*b* of the cam member are merely examples. The shape of the outer peripheral edge 187*b* may be set in such a manner that the protrusion length of the pressing member in the stage in (d) becomes the maximum similarly to that in (e). Alternatively, the shape of the outer peripheral edge 187*b* may be configured in such a manner that the circumferential surface of the contact piece is in light contact with the loading surface 200*a* of the loading platform in each of the stages in FIGS. 11(*g*) to (*i*).

In FIG. 10(*e*) and FIGS. 11(*f*) to (*i*), even if the cam member 187 rotates, the first link piece is stopped without swinging around the shaft portion 186*b*, and the pressing member continues to maintain the same protruding position.

In (e) to (i), a non-contact state between the outer peripheral edges of the rotating bodies and the loading surface 200*a* (or a banknote surface on the loading surface) is supposed to be able to be ensured, if the distance between the pressing surface 140*b* of the pressing member and the outer peripheral edges 124*a* and 134*a* of the rotating bodies when the pressing surface 140*b* is located at the most protruding position, in other words, a value of a gap G between the outer peripheral edges of the rotating bodies and the loading surface 200*a* (or the banknote surface on the loading surface) is about 0.1 mm numerically, for example. However, because there is actually a possibility of contact caused by local protrusion because of a crease, a wrinkle, or the like, and a difference of a banknote condition such as undulation, it is preferable to set the gap to a large value with room. Therefore, a value of the gap G can be set to about 0.1 to 3 mm, for example, and more specifically a range from 1 to 2 mm is preferable. However, this setting is merely an example. The value of the gap G can be changed in various ways in accordance with various banknote conditions such as the material of the banknote to be processed or the degree of damage. Further, it is unnecessary that the outer peripheral edge of the rotating body and a banknote surface on the loading surface are not in contact with each other. There is no problem if the rotating body always or sometimes comes into light contact or partial contact with a banknote to such an extent the rotating body does not affect the position and posture of the banknote.

In FIG. 11(*f*), the cam member further pivots more than in the state in FIG. 10(*e*) by 45 degrees, that is, by 135 degrees in total in the counterclockwise direction, and the respective rotating bodies 120 and 130 also further pivot by 45 degrees in the banknote leaving directions. Therefore, the postures of the recesses 120*a* and 130*a* of the respective rotating bodies have an inverted V shape, which are open to the loading surface 200*a*, so that both the ends of the banknote completely leave and are transferred onto the loading platform.

In FIG. 10(*d*) to FIG. 11(*f*), displacement of the banknote is prevented by pushing out the center of the banknote by the pressing member and pressing the center against the loading surface of the loading platform to be in contact therewith, and thereafter the rotating bodies are caused to retreat so as to release pressure application on the banknote by the rotating bodies. Therefore, the banknote can be transferred onto the loading surface 200*a* while maintaining the posture and the positional relation when the banknote is set in the banknote setting portion (the banknote setting space) 108. By repeating this accommodating operation for subsequent banknotes, it is possible to transfer and load the banknotes onto the loading surface stably without causing occurrence of displacement or drop of a banknote (a newly loaded banknote and an already loaded banknote).

In the present invention, a time during which a pressing member presses a banknote against a loading surface is made as long as possible by devising the shape of a cam member that determines operation timings of a pantograph mechanism and rotating bodies. Meanwhile, a time during which the rotating bodies rotate while being in contact with the banknote B transferred onto the loading surface 200*a* is shortened. In a period during which the pressing member presses the banknote against the loading surface, it is less likely that displacement or the like occurs even if the rotating body that is rotating comes into light contact with the banknote on the loading surface. Further, by adjusting the protrusion length of the pressing member in such a manner that the rotating body does not come into contact with the banknote as in the present embodiment the rotating body does not adversely affect the banknote.

Further, the pantograph mechanism has a small number of components and can be made compact, and is suitable for quick and parallel movement in an accommodating operation without causing the posture of the pressing member to be biased or causing vibration. Therefore, it is possible to achieve the stable accommodating operation continuously in a short time.

In each of the stages in FIGS. 11(*g*), (*h*), and (*i*), the cam member 187 continues to rotate. However, during this time period, the other end portion 186*d* of the first link piece continues to slide on the arc-shaped outer peripheral edge 187*b* of the cam member. Therefore, the pantograph mechanism 180 including the first link piece 186 does not expand and contract, so that the protruding position of the pressing member 140 is not also changed. In this period, each rotating body only continues to rotate in order to return to its initial position. Because the banknote is pressed against the loading surface by the pressing member and displacement of the banknote is prevented, the rotating bodies can rotate while the outer peripheral edges 124*a* and 134*a* of the contact pieces of the rotating bodies are kept in a non-contact state with respect to the banknote. There is no problem if the outer peripheral edge of the contact piece comes into light contact with the banknote.

In (g), the cam member further pivots more than in the state in (f) by 45 degrees, that is, by 180 degrees in total in the counterclockwise direction, and the respective rotating bodies 120 and 130 also further pivot by 45 degrees in the banknote leaving directions.

In (h), the cam member further pivots more than in the state in (g) by 45 degrees, that is, by 225 degrees in total in the counterclockwise direction, and the respective rotating bodies 120 and 130 also further pivot by 45 degrees in the banknote leaving directions.

In (i), the cam member further pivots more than in the state in (h) by 45 degrees, that is, by 270 degrees in total in the counterclockwise direction, and the respective rotating bodies 120 and 130 also further pivot by 45 degrees in the banknote leaving directions. In this stage, the rotating bodies have not completed a revolution of 360 degrees.

As described above, in each of the stages in FIG. 10(*e*) and FIG. 11(*f*) to FIG. 11(*i*) the protruding position of the pressing member is not changed because the arc shape of the arc-shaped outer peripheral edge 187*b* of the cam member 187 with which the other end portion 186*d* of the link piece comes into contact is set to be equidistant from the center of rotation of the cam member. However, in the stage in (j), the other end portion 186*d* of the link piece has left an end portion of the arc-shaped outer peripheral edge 187*b* of the cam member and starts to be transferred to the concave portion 187*a*. Therefore, the first and second link pieces each start to operate in the retreat direction. Accordingly, the pressing member is transferred to a position that retreats slightly behind the most-protruding position in (i). With this retreat operation of the pressing member, the outer peripheral edge of each rotating body comes into contact with the banknote B on the loading platform in place of the pressing member, and starts to press down the banknote.

(k) illustrates a state where the rotating bodies have completed a revolution of 360 degrees and the pressing member returns to its initial position illustrated in FIG. 10(*a*) because of a returning operation of a pantograph, so that a banknote accommodating work has been finished.

In the present embodiment, the rotating bodies 120 and 130 rotate by about 195 degrees in a time period from the stage in (d) in which the pressing member 140 starts to press the center of a banknote against the loading surface 200*a* (the rotation angle of each rotating body is 75 degrees) to the stage in (i) immediately before the pressing member 140 finishes pressing and retreats (the rotation angle of each rotating body is 270 degrees). Therefore, in most of a time of a work of transferring the banknote onto the loading surface, the pressing member presses the banknote against the loading surface alone to bring it into contact therewith. During this time period, the outer peripheral edges 124*a* and 134*a* of the rotating bodies are not in contact with the banknote. That is, a time period during which the rotating bodies press the banknote against the loading surface to bring it into contact therewith while rotating in a state where the pressing member has left the banknote is limited to a significantly short time period illustrated in (j) to (k) (the rotation angle of the rotating bodies is 45 degrees), and it is possible to minimize the opportunity for the rotating bodies to adversely affect the banknote on the loading platform.

In this manner, in the present embodiment, the drive mechanism 160 rotates each rotating body by 75 degrees by the time when the pressing member 140 starts to bring the center of a banknote into contact with a banknote loading platform from an initial state, and further rotates each rotating body by 195 degrees at a maximum (270 degrees from the initial state of the pressing member) in a time period until the pressing member leaves the center of the banknote.

75 degrees described as the rotation angle of each rotating body until the operation reaches the state in the right portion in (d) and 270 degrees described as the rotation angle of each rotating body until the operation reaches the state in the right portion in (i) are merely an example. For example, each rotating body may rotate by 45 degrees by the time when the operation reaches the state in the right portion in (d) where the pressing member starts to press a banknote against a loading surface to bring it into contact therewith, and the rotation angle of each rotating body until the operation reaches the state in the right portion in (j) where the pressing is released may be about 315 degrees at a maximum. In this case, the pressing member continues to press the banknote against the loading surface alone during a time period of 270-degree rotation of each rotating body.

Therefore, in the present embodiment, each rotating body rotates by an angle from 195 degrees to 270 degrees in a time period after the pressing member starts to bring the center of the paper sheet into contact with a paper sheet loading platform from an initial state until the pressing member leaves the center of the paper sheet.

Accordingly, a time period during which the pressing member continues to press a banknote against the loading platform alone is increased, so that a time period during which the rotating bodies press the banknote against the loading platform alone can be shortened correspondingly. In the example of FIG. 11, the rotating bodies continue to press down the banknote alone only for a time period of 45 degree rotation from (j) to (k).

Further, during the time period during which the pressing member presses the center of the banknote against the banknote loading platform, the outer peripheral edges (the outer circumferential surfaces) 124*a* and 134*a* of the respective rotating bodies maintain a non-contact state with respect to the banknote or only come into light contact that is close to non-contact (such a contact that adverse effects on the banknote such as displacement, do not occur).

Therefore, there is almost no time period during which, while the pressing member presses down the banknote on the loading surface to bring it into contact therewith, the rotating bodies continue to be in contact with the banknote while rotating. Further, a time period during which the rotating bodies continue to be in contact with the banknote while rotating, in a state where the pressing member leaves the loading surface is very short. Therefore, there is no room for occurrence of errors that the rotating bodies vary the position of the banknote on the loading surface.

As described in connection with Patent Literature 1, if a banknote is pressed only by the outer peripheral edges of the rotating bodies when the banknote is not being sandwiched and pressed between the pressing member and the loading platform, the banknote on the loading platform can be easily displaced by being led by rotation of the rotating bodies. However, according to the present invention, pressing of the banknote by the pressing member is performed for a long period, and there is almost no opportunity that the rotating bodies come into contact with the banknote while rotating in that period. Therefore, there is no room for occurrence of erroneous loading such as displacement of a banknote or drop of the banknote when the banknote is transferred.

[Banknote Processing Device]

Figure 12A:
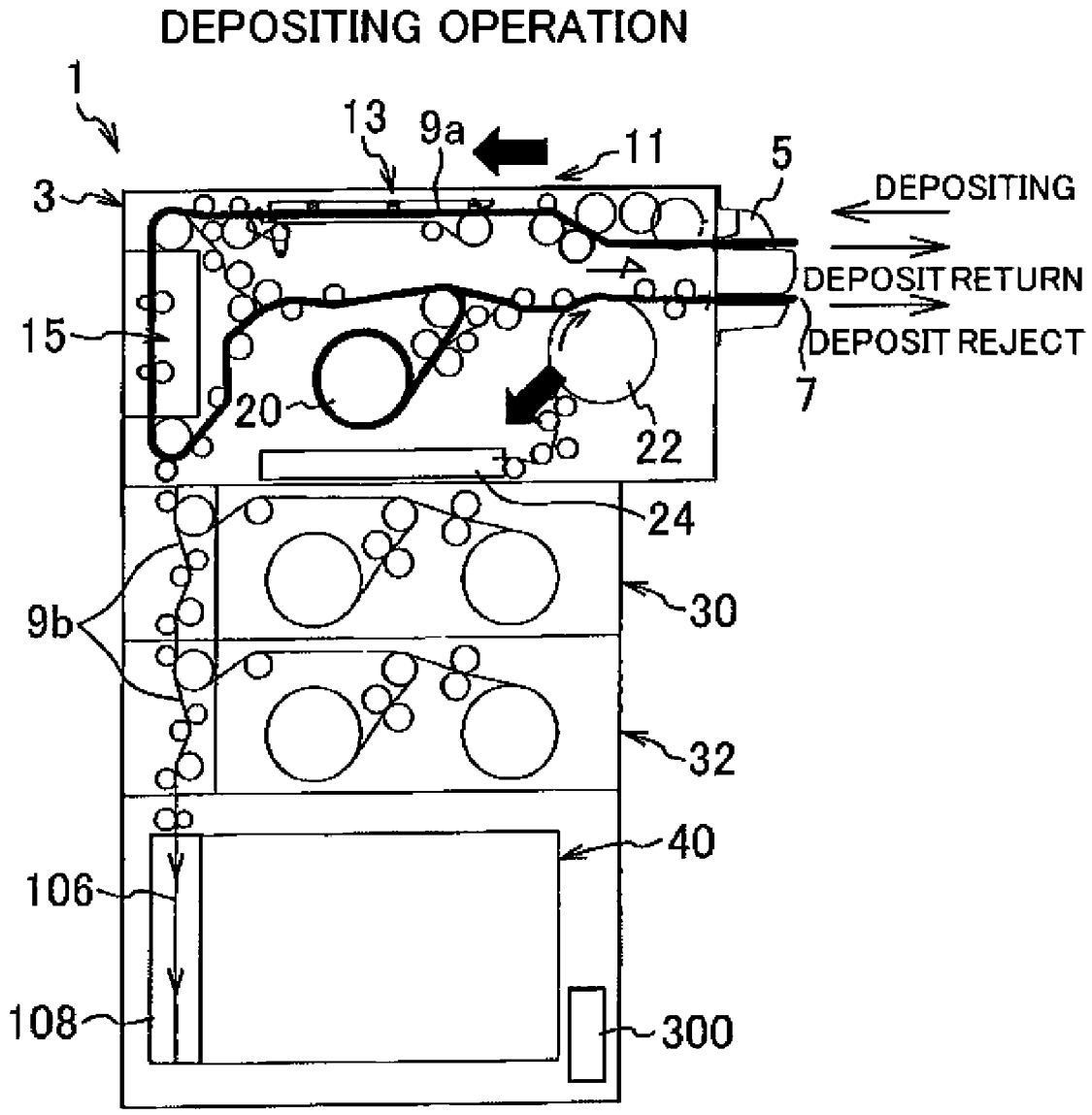
FIGS. 12(*a*) and (*b*) are explanatory diagrams of a depositing operation and a confirming operation of the banknote processing device.
Figure 12B:
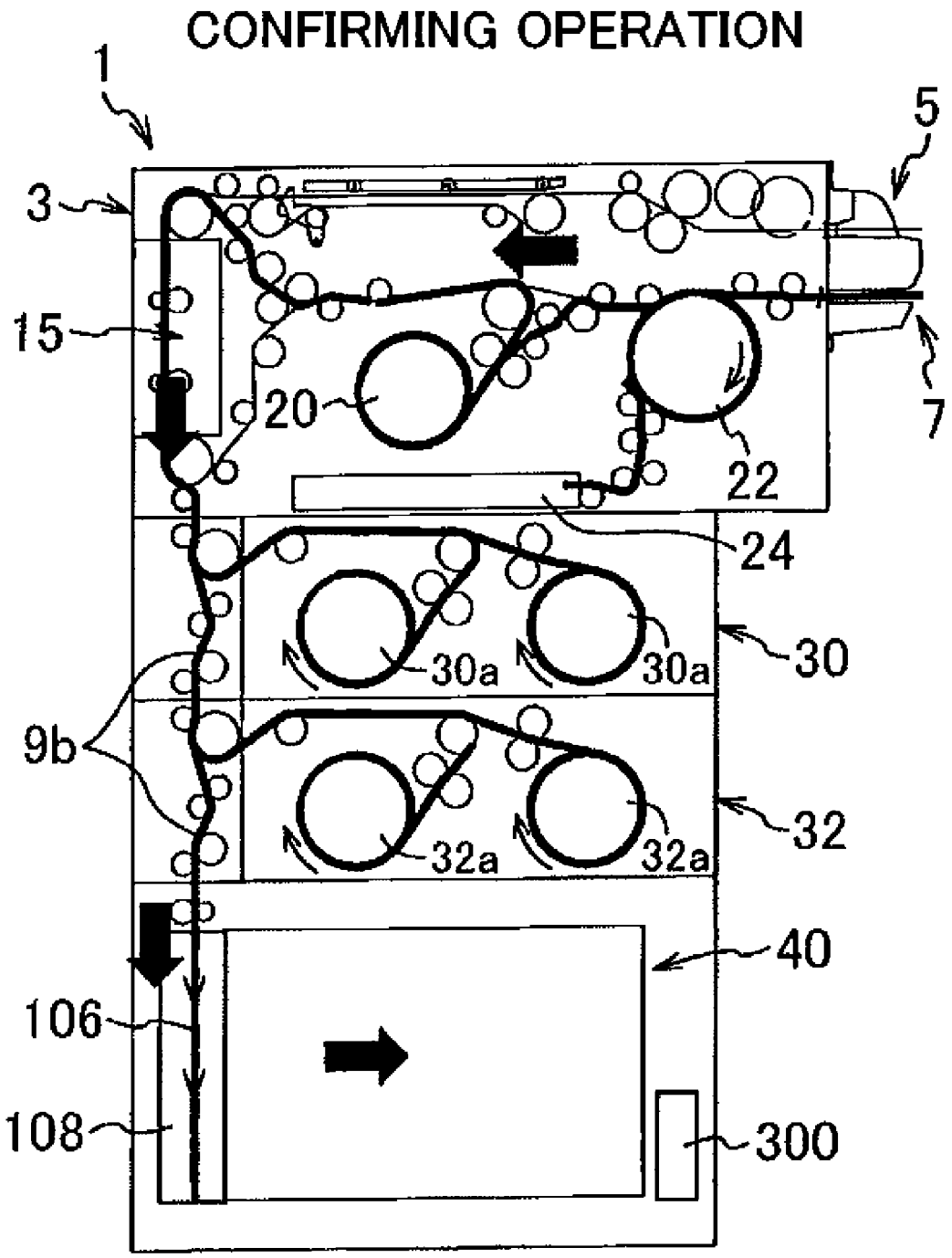
Figure 13A:
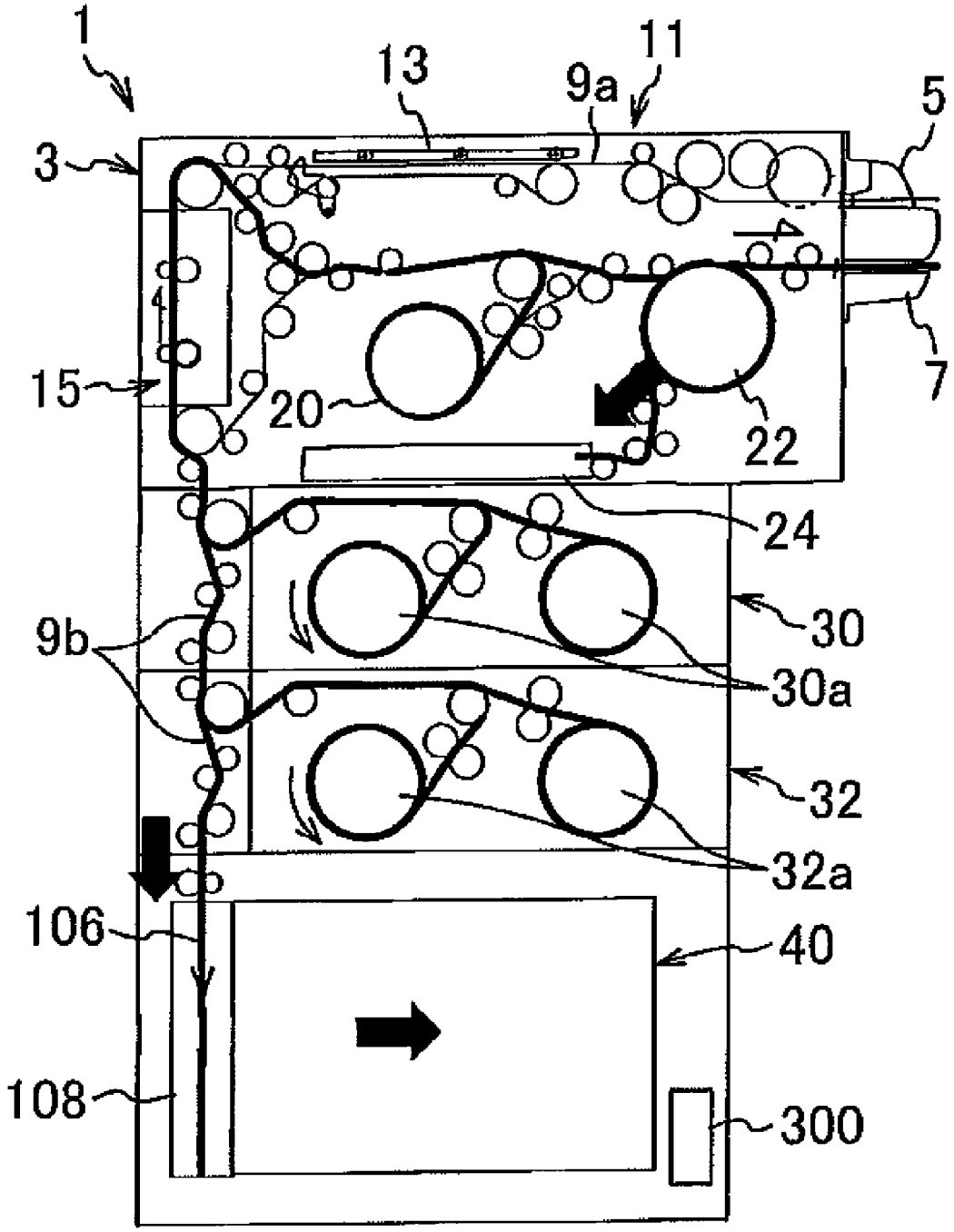
FIGS. 13(*a*) and (*b*) are explanatory diagrams of a dispensing operation and a collecting operation of the banknote processing device.
Figure 13B:
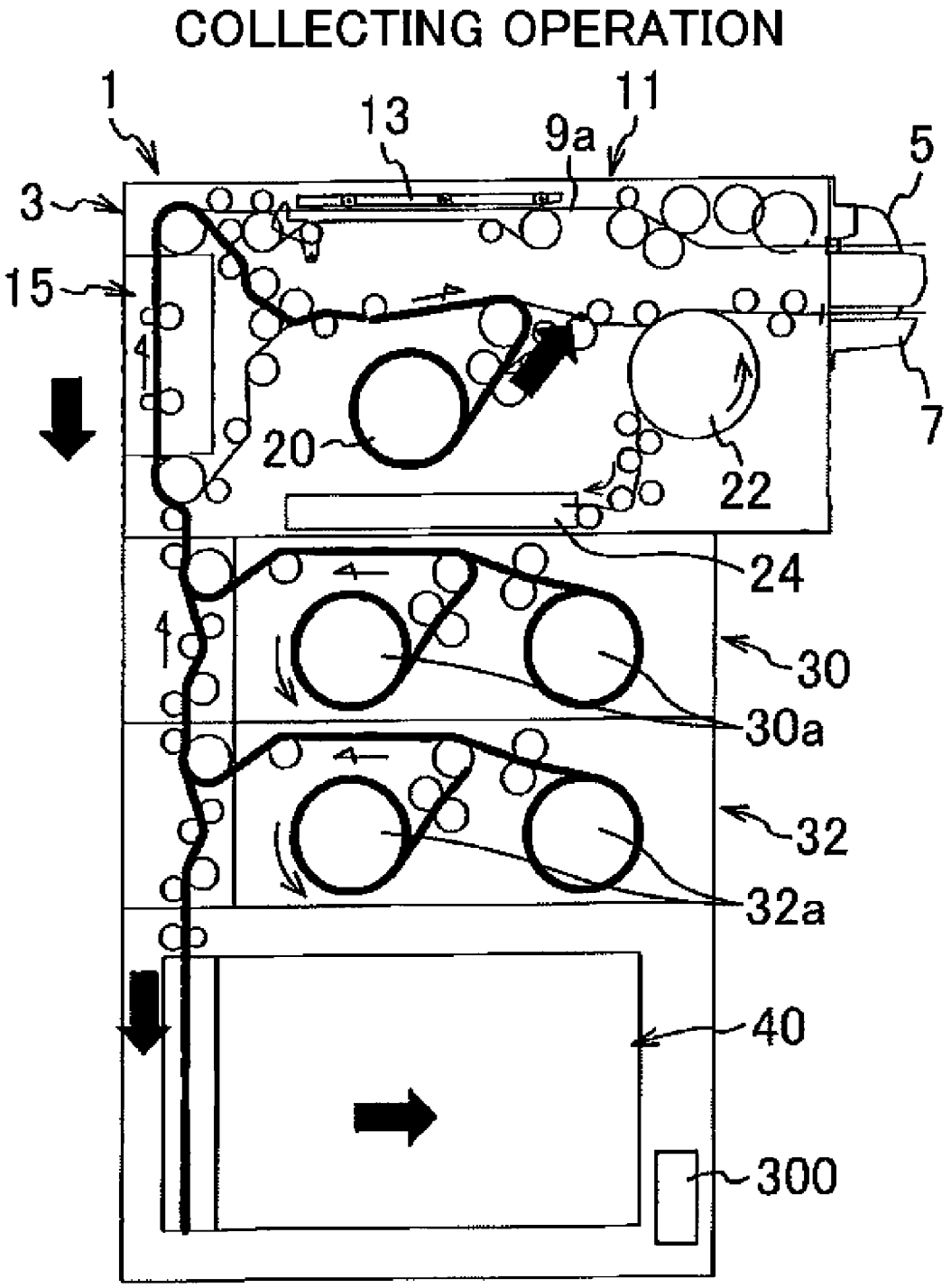

Next, the outline of a depositing operation, a confirming operation, a dispensing operation, and a collecting operation in the banknote processing device 1 illustrated in FIG. 1 that has the collection container (the collected banknote accommodating unit) 40 according to the present invention is described referring to FIGS. 12 and 13.

FIGS. 12(*a*) and (*b*) are explanatory diagrams of a depositing operation and a confirming operation of a banknote processing device, and FIGS. 13(*a*) and (*b*) are explanatory diagrams of a dispensing operation and a collecting operation thereof.

First, in the depositing operation in FIG. 12(*a*), when one banknote or a plurality of banknotes is/are inserted through the depositing/dispensing slot (the depositing/dispensing unit) 5, a control unit 300 that receives a signal from a sensor that has detected the banknote(s) causes a transport mechanism to operate, and takes in the banknote(s) by using the collective depositing unit 11 and the deposited banknote transport path 9*a*. The collective depositing unit 11 picks up the uppermost banknote from a batch of banknotes set in the depositing/dispensing slot 5 and transports it to the centering unit 13. The banknote transported to the centering unit is subjected to centering is then moved to the recognizing unit 15, and is subjected to recognition. A banknote that is determined by the recognizing unit 15 as being acceptable is transported to the escrow unit 20, is wound around an outer circumference of a drum one by one to be temporarily reserved, and waits for confirming of deposit. A rejected banknote that is determined by the recognizing unit as being not acceptable is accumulated in the payout accumulating unit 22 once, and is then returned through the return slot 7.

In the confirming operation in FIG. 12(*b*), in a stage where deposit of the inserted banknote that is temporarily reserved in the escrow unit 20 is confirmed, the escrow unit sends out the banknote one by one. A banknote used as change is accommodated in any of the circulation type accommodating units 30 and 32 for each domination via the accommodated banknote transport path 9*b*. A banknote not used as change is accommodated in the collection container 40.

In the dispensing operation in FIG. 13(*a*), when a banknote is paid out as change, a banknote accommodated in the circulation type accommodating unit 30 or 32 is taken out and is paid out through the return slot 7 via the accommodated banknote transport path 9*b*.

In the collecting operation in FIG. 13(*b*), banknotes accommodated in the circulation type accommodating units 30 and 32 are accumulated in the escrow unit 20 once at closing time and the like, and are then accommodated in the collection container 40.

[Summary of configurations, actions, and effects of present invention]

The paper sheet accommodating unit 40 according to the first invention is characterized by including the paper sheet setting portion 108 that stops a transported paper sheet at a setting position, the two rotating bodies 120 and 130 that have recesses 120*a* and 130*a* respectively holding both edges in the width direction of one paper sheet located at the setting position when the rotating bodies 120 and 130 are in initial rotating postures, and that are rotatable in opposite directions to each other in synchronization with each other, the pressing member 140 that is arranged between the two rotating bodies and is located on the back side of the paper sheet located at the setting position in an initial state, comes into contact with an intermediate portion in the width direction of the back of the paper sheet and pushes it forward when protruding forward beyond the setting position, and can be ejected or retracted, the drive mechanism 160 that drives each rotating body and the pressing member to cause them to work together, and the paper sheet loading platform 200 that is located in a paper sheet accommodating space ahead of the two rotating bodies, is elastically biased toward an outer circumferential surface of each rotating body to be pressed against and come in contact with the outer circumferential surface, and can be ejected or retracted in a direction away from each rotating body. The paper sheet accommodating unit 40 according to the first invention is also characterized in that, in conjunction with an operation in which the pressing member protrudes to press the center of the paper sheet forward, the rotating bodies start to rotate in synchronization with each other in such directions that the edges of the paper sheet accommodated in the recesses are deformed to the back direction and leave the recesses, in an appropriate stage after pressing of the paper sheet by the pressing member progresses and the front surface of the center of the paper sheet comes into contact with the paper sheet loading platform, the pressing member stops a protruding operation, also after the pressing member stops a protruding operation, the rotating bodies continue to rotate, thereby causing both the edges of the paper sheet to leave the respective recesses and transferring the entire paper sheet onto the paper sheet loading platform, also after both the edges of the paper sheet leave the recesses, the rotating bodies continue to rotate in the same directions and return to the initial rotating postures, the pressing member returns to an initial state before or after the rotating bodies return to the initial rotating postures, and the drive mechanism 160 rotate each rotating body by an angle from 195 to 270 degrees in a time period after the pressing member starts to bring the center of the paper sheet into contact with the paper sheet loading platform from the initial state until the pressing member leaves the center of the paper sheet.

Further, the paper sheet accommodating unit 40 according to the second invention is characterized in that the drive mechanism rotates each rotating body by an angle exceeding 45 degrees by the time when the pressing member starts to bring the center of the paper sheet into contact with the paper sheet loading platform from the initial state, and further rotates each rotating body by 315 degrees at a maximum in a time period until the pressing member leaves the center of the paper sheet.

According to this configuration, there is almost no time period during which, when the pressing member is pressing the paper sheet against the loading surface 200*a* of the paper sheet loading platform, the rotating bodies continues to be in contact with the paper sheet while rotating. Therefore, there is no room for occurrence of errors that the rotating bodies displace the position of the paper sheet on the loading surface and vary the position.

That is, when the rotating bodies start to rotate before the pressing member starts to sandwich and hold the paper sheet between the loading surface and the pressing member, the paper sheet is led by either one of the rotating bodies to be displaced. Therefore, while a state where the pressing member is caused to protrude and sandwich the paper sheet between the loading platform surface and the pressing member is maintained, the rotating bodies are caused to rotate. Accordingly, it is possible to efficiently perform an accommodating process for various types of paper sheets having various width-direction dimensions without causing displacement or drop thereof.

Even if the rotating bodies rotate while being in contact with a portion near both ends of the paper sheet that is pressed against the loading surface at its center, a time period of the contact is vey short. Therefore, there is almost no risk of occurrence of errors that the rotating bodies vary the position of the banknote on the loading surface.

Further, because it is unnecessary to continue to press the paper sheet by the rotating bodies for a long time after the pressing member leaves the paper sheet, it is possible to shorten the circumferential length of the outer circumferential surface of each rotating body and to downsize each rotating body.

The phrase "rotate(s) each rotating body by an angle from 195 to 270 degrees" means that a range of rotation of each rotating body can be set to any value as long as the value is within a range from 195 to 270 degrees.

The paper sheet accommodating unit 40 according to the third invention is characterized in that, during a time period during which the pressing member presses the center of the paper sheet against the paper sheet loading platform, the outer circumferential surface of each rotating body maintains a non-contact state with respect to the paper sheet or comes into light contact that is close to non-contact.

According to this configuration, during the time period during which the pressing member continues to press the paper sheet against the paper sheet loading platform surface, the rotating bodies that continue to rotate in order to return to the initial rotating postures and the paper sheet are not in contact with each other or merely come into light contact that is equivalent to non-contact. Therefore, there is no room for occurrence of errors that the rotating bodies vary the position of the paper sheet on the loading surface.

The paper sheet accommodating unit 40 according to the fourth invention is characterized in that the recesses 120*a* and 130*a* each extend in the diameter direction of the corresponding rotating body to include the rotation center axis of the corresponding rotating body.

According to this configuration, it is possible to ensure a large opening width of the recess and to ensure a large depth of the recess. Therefore, it is possible to introduce and hold both end portions of a paper sheet having the maximum si/e with room without making the diameter of each rotating body large. Further, it is possible to accommodate a deformed paper sheet such as a creased paper sheet in the paper sheet setting portion formed between the recesses with room.

Further, pressing of the paper sheet against the loading surface is performed mainly by the pressing member, and it is unnecessary to ensure a long time of pressing the paper sheet by the circumferential surface of each rotating body. Therefore, it is possible to make the width in the circumferential direction (the opening width) of the recess provided in the outer circumferential surface of the rotating body as large as possible. That is, because a time of pressing the paper sheet by the circumferential surfaces of the rotating bodies is originally short in this configuration, an effect of pressing down the paper sheet is not adversely affected even if the opening width of the supporting recess is large.

The paper sheet accommodating unit 40 according to the fifth invention is characterized in that the drive mechanism 160 includes the driven gears 162 and 163 arranged at one axial end portions of the respective rotating bodies, the rotation-shaft member 170 arranged to cross a rotation axis of the rotating bodies, the two rotating-body driving gears 172 and 173 that are arranged to be fixed onto the rotation-shaft member and drive the rotating bodies via the driven gears, respectively, the pressing-member driving gear 175 fixed on the rotation-shaft member between the rotating-body driving gears, and the pantograph mechanism 180 that is driven by the pressing-member driving gear to eject or retract the pressing member.

Differently from Patent Literature 1, according to the present invention, a timing of a reciprocating operation of the pressing member, particularly a time (a time period) during which the pressing member continues to press a banknote against the banknote loading platform does not depend on a rotation period of the rotating bodies, but relies on the separate pantograph mechanism. Therefore, it is possible to set a peripheral velocity of the rotating bodies to any speed separately from the time during which the pressing member continues to press the banknote against the loading platform. Accordingly, it is possible to set the rotation angle of the rotating bodies in the time during which the pressing member continues to press the banknote against the loading platform, to a large angle, so that the possibility that the rotating bodies adversely affect the banknote can be largely reduced.

According to the pantograph mechanism, operation variations such as inclination or vibration when the pushing member is being ejected or retracted are eliminated, and it is possible to perform parallel movement stably. Further, because a movable range of the pressing member is narrow, it is possible not only to improve the durability and reduce vibration, but also to achieve a small number of components and downsizing.

The paper sheet processing device 1 according to the sixth invention is characterized by including the paper sheet accommodating unit 40 according to any one of the first to fifth inventions.

The paper sheet processing device can obtain actions and effects according to the respective embodiments by including a collected paper sheet accommodating unit according to the respective embodiments.

REFERENCE SIGNS LIST

1 banknote processing device, 3 case, 3*a* accommodating space, 5 depositing/dispensing slot, 7 return slot, 9*a* deposited banknote transport path, 9*b* accommodated banknote transport path, 11 collective depositing unit, 13 centering unit, 15 recognizing unit, 20 escrow unit, 22 accumulating unit, 30 circulation type accommodating unit, 30*a* circulation drum, 32 circulation type accommodating unit, 40 banknote accommodating unit (collection container), 100 casing, 100*a* banknote accommodating space, 102 receiving inlet, 104*a* pair of receiving rollers, 16 introduction path, 108 setting position (banknote setting portion), 120 rotating body, 120*a* recess, 120*b* front-side edge, 120*c* back-side edge, 122, 132 core portion, 124, 134 contact piece, 124*a*, 134*a* outer peripheral edge, 124*b* bottom contact piece, 140 pressing member, 140*a* elongated hole, 140*b* pressing surface, 160 drive mechanism, 162, 163 rotating-body side driven gear, 170 rotation-shaft member, 172, 173 rotating-body driving gear, 175 pressing-member driving gear, 176 shaft-member driving gear, 180 pantograph mechanism, 182 rotation shaft, 184 driven gear, 185 shaft portion, 186 first link piece, 186*a* shaft supported portion, 186*b* shaft portion, 186*c* pin, 186*d* other end portion, 187 cam member, 187*a* concave portion, 187*b* outer peripheral edge, 190 second link piece, 191 shaft supporting portion, 195 torsion spring, 200 banknote loading platform, 200*a* banknote loading platform surface, 200*a* loading surface, 201 loading-platform ejecting/retracting mechanism, 210 loading-platform ejecting/retracting mechanism, 211 rack gear pair, 214 gear supporting portion, 215 pinion gear, 216 pinion gear, 216*a* rotation shaft, 218 coil spring, 300 control unit

The invention claimed is:

1. A paper sheet accommodating unit comprising:

a paper sheet setting portion that stops a transported paper sheet at a setting position;

two rotating bodies that have recesses respectively holding both edges of one paper sheet located at the setting position when being in initial rotating postures, and they are rotatable in opposite directions to each other in synchronization with each other;

a pressing member that is arranged between the two rotating bodies, is located on a back side of the paper sheet located at the setting position in an initial state, and is movable and, when protruding forward beyond the setting position, comes into contact with an intermediate portion of a back of the paper sheet and pushes the paper sheet forward;

a drive mechanism that drives the rotating bodies and the pressing member to cause the rotating bodies and the pressing member to work together; and a paper sheet loading platform that is located in a paper sheet accommodating space ahead of the two rotating bodies, is elastically biased toward outer circumferential surfaces of the rotating bodies to be pressed against and be in contact therewith, and can be ejected or retracted in a direction away from the rotating bodies, wherein in conjunction with an operation in which the pressing member protrudes and presses a center of the paper sheet forward, the rotating bodies start rotating in such directions that the edges of the paper sheet accommodated in the respective recesses are deformed to a back direction and leave from the recesses, in synchronization with each other, the pressing member stops a protruding operation in an appropriate stage after pressing of the paper sheet by the pressing member progresses and a front surface of the paper sheet comes into contact with the paper sheet loading platform, the rotating bodies continue the rotating also after the pressing member stops a protruding operation, to cause both the edges of the paper sheet to leave the recesses and transfer an entire paper sheet onto the paper sheet loading platform, the rotating bodies continue rotating in the same directions also after both the edges of the paper sheet leave the recesses, to return to the initial rotating postures, the pressing member returns to the initial state before or after the rotating bodies return to the initial rotating postures, the drive mechanism rotates each of the rotating bodies by an angle from 195 degrees to 270 degrees in a time period after the pressing member starts to bring the paper sheet into contact with the paper sheet loading platform from the initial state until the pressing member leaves the paper sheet, and the drive mechanism rotates each of the rotating bodies by an angle exceeding 45 degrees by a time until the pressing member starts to bring the paper sheet into contact with the paper sheet loading platform from the initial state, and further rotates each of the rotating bodies by 315 degrees at a maximum in a time period until the pressing member leaves the paper sheet.

2. The paper sheet accommodating unit according to claim 1, wherein the outer circumferential surfaces of the respective rotating bodies are kept in a non-contact state with respect to the paper sheet or come into light contact that is close to non-contact, during a time period during which the pressing member presses the paper sheet against the paper sheet loading platform.

3. The paper sheet accommodating unit according to claim 1, wherein each of the recesses extends in a diameter direction of one of the rotating bodies to include a rotation center axis of the corresponding rotating body.

4. The paper sheet accommodating unit according to claim 1, wherein the drive mechanism includes driven gears respectively arranged at one axial end portions of the rotating bodies, a rotation-shaft member arranged to cross a rotation axis of the rotating bodies, two rotating-body driving gears that are arranged to be fixed on the rotation-shaft member and drive the rotating bodies via the driven gears, respectively, a pressing-member driving gear fixed onto the rotation-shaft member between the rotating-body driving gears, and a pantograph mechanism driven by the pressing-member driving gear to eject or retract the pressing member.

5. A paper sheet processing device comprising the paper sheet accommodating unit according to claim 1.

* * * * *